US011353283B2

(12) United States Patent
Cuenca et al.

(10) Patent No.: US 11,353,283 B2
(45) Date of Patent: Jun. 7, 2022

(54) ROTATABLE FORWARD GRIP

(71) Applicants: Jojo De Vera Cuenca, San Francisco, CA (US); Joel Asuncion Dionisio, Daly City, CA (US)

(72) Inventors: Jojo De Vera Cuenca, San Francisco, CA (US); Joel Asuncion Dionisio, Daly City, CA (US)

( * ) Notice: Subject to any disclaimer, the term of this patent is extended or adjusted under 35 U.S.C. 154(b) by 267 days.

(21) Appl. No.: 16/396,631

(22) Filed: Apr. 26, 2019

(65) Prior Publication Data

US 2020/0340776 A1 Oct. 29, 2020

(51) Int. Cl.
*F41B 11/70* (2013.01)
*F41C 23/16* (2006.01)

(52) U.S. Cl.
CPC ..... *F41B 11/70* (2013.01)

(58) Field of Classification Search
CPC ..... F41C 23/14; F41C 23/16; F41B 11/70
USPC ..... 124/71; 42/71.01, 72, 73; 89/1.42
See application file for complete search history.

(56) References Cited

U.S. PATENT DOCUMENTS 2,826,848 A * 3/1958 Davies ..... F41A 35/06 42/71.01
3,164,920 A * 1/1965 Haas, Jr. ..... F41C 23/16 42/71.01
3,623,257 A * 11/1971 Ray ..... F41C 23/16 42/71.01
5,048,215 A * 9/1991 Davis ..... F41C 23/22 42/72
5,068,992 A * 12/1991 Velezis ..... F41A 35/06 42/72
5,417,002 A * 5/1995 Guerra ..... F41C 23/16 42/72
6,397,507 B1 * 6/2002 Marshall ..... F41C 23/16 42/106
6,658,781 B1 * 12/2003 Bowen ..... F41C 23/12 42/71.02
6,901,691 B1 * 6/2005 Little ..... F41A 23/02 42/118
7,434,344 B2 * 10/2008 Golan ..... F41C 23/04 42/72
7,454,858 B2 * 11/2008 Griffin ..... F41C 23/16 42/71.01
7,665,239 B1 * 2/2010 Moody ..... F41C 23/16 42/72
7,676,975 B2 * 3/2010 Phillips ..... F41C 23/14 42/72

(Continued)

*Primary Examiner* — Alexander R Niconovich
(74) *Attorney, Agent, or Firm* — Patential; Keum J. Park

(57) ABSTRACT

Provided herein are rotatable forward grips for use with paintball markers. The forward grips can be components of a paintball marker body or can be attachments to be connected to existing paintball marker bodies and barrels. The rotation of the forward grip elements permits an operator of the paintball marker to move other paintball marker components, such as a hopper, out of the line of sight from the operator to the target. In some embodiments, the rotatable forward grip includes a stopper that can hold and release the forward grip in different rotational positions. In some embodiments, the rotatable forward grip is repositionable and can be moved from, for example, the paintball marker body to the paintball marker barrel. Also provided are kits and methods that include the provided rotatable forward grips.

15 Claims, 19 Drawing Sheets

(56) References Cited

U.S. PATENT DOCUMENTS

| | | | | |
|---|---|---|---|---|
| 7,937,875 | B1 * | 5/2011 | Berg | F41C 23/12 42/72 |
| 8,176,669 | B1 * | 5/2012 | Griffin | F41C 23/16 42/90 |
| 8,429,843 | B2 * | 4/2013 | Yan | F41C 23/16 42/72 |
| 8,601,734 | B1 * | 12/2013 | Hopkins | F41C 23/14 42/73 |
| 8,950,387 | B2 * | 2/2015 | Stevens | F41B 11/70 124/73 |
| 9,010,008 | B2 * | 4/2015 | Hovey | F41C 23/16 42/72 |
| 9,573,268 | B2 * | 2/2017 | Azhocar | F41C 23/14 |
| 9,718,182 | B2 * | 8/2017 | Azhocar | B25G 3/36 |
| 10,094,635 | B2 * | 10/2018 | Holmes | F41C 23/16 |
| 10,852,098 | B1 * | 12/2020 | Wei | F41B 11/723 |
| 10,866,061 | B2 * | 12/2020 | Anstett | F41C 23/16 |
| 2004/0011344 | A1 * | 1/2004 | Rice | F41C 23/10 124/73 |
| 2006/0191183 | A1 * | 8/2006 | Griffin | F41C 23/16 42/72 |
| 2009/0193702 | A1 * | 8/2009 | Lin | F41C 23/16 42/72 |
| 2014/0182182 | A1 * | 7/2014 | Adcock, Jr. | F41C 23/22 42/72 |
| 2014/0215884 | A1 * | 8/2014 | Adcock, Jr. | F41C 27/16 42/72 |
| 2016/0061560 | A1 * | 3/2016 | Saadon | F41C 23/16 42/72 |
| 2016/0153743 | A1 * | 6/2016 | Hawkins | F41C 23/12 42/71.01 |
| 2018/0335274 | A1 * | 11/2018 | Cuenca | B23B 31/20 |
| 2020/0340776 | A1 * | 10/2020 | Cuenca | F41B 11/70 |

* cited by examiner

ROTATABLE FORWARD GRIP

BACKGROUND

Paintball is a competitive team shooting sport in which players eliminate opponents from play by hitting them with spherical dye-filled gelatin capsules ("paintballs") that break upon impact. Paintballs are usually shot using a low-energy air weapon called a paintball marker, that was originally designed for remotely marking trees and cattle. A paintball marker, also known as a paintball gun, paint gun, or marker, uses expanding gas such as carbon dioxide ($CO_2$) or compressed air (or nitrogen) to propel paintballs through a barrel and quickly strike a target.

Most paintball markers are assembled from four main components: a body, a barrel, a gas or propellant system, and a hopper. The body includes most of the functional features of the paintball marker, such as the main components of the firing mechanism. The barrel is connected to the muzzle end of the body and controls the release of a gas pocket behind the paintball, directing the paintball away from the marker and towards the target. The propellant system or tank is usually located at the rear of the paintball marker, and holds the gas used to drive the paintball through the barrel. The hopper contains the supply of paintballs for the marker and is typically mounted to the body in a vertically higher position relative to the marker. This arrangement of the hopper and the body assists in the gravity feeding of paintballs into the body chamber. The location of the hopper directly above the marker body can have the undesired effect, however, of at least partially blocking the view of a paintball marker operator towards the target. In view of this undesired characteristic, the need exists for paintball markers and associated components that better allow a user to form and maintain a clear line of sight to a target. The disclosure provided herein addresses this and other needs.

BRIEF SUMMARY

In general, provided herein are paintball markers, paintball marker components, and methods involving the use of a rotatable forward grip. The rotatable grip enables an operator of a paintball marker to better adjust the orientation of the marker within his or her grip and, in particular, to adjust the orientation of different paintball marker components with respect to one another. For example, the rotatable grip can be used to pivot the paintball marker body relative to the grip such that one or more components (e.g., a hopper) can be moved away from the line of sight of the operator. The rotatable forward grip can also have a mechanism that fixes the grip location (e.g., about the paintball marker barrel or body) when pivoting of the marker is not needed. This enhancement prevents the rotatable grip from sacrificing stability in exchange for improved positional flexibility.

One rotatable forward grip component that is provided includes a cylindrical shaft, a grip member, a torsion spring, a trigger lever, and a stopper. The cylindrical shaft has a first longitudinal end, a second longitudinal opening at an opposite second longitudinal end, a stopper opening in a radial wall, and a hollow interior connecting the first and second longitudinal openings and the stopper opening. The grip member is connected to the radial wall of the shaft proximate to the stopper opening. The torsion spring is connected to and within the grip member. The trigger lever is connected to the torsion spring and configured to move the torsion spring from a relaxed position to a tensioned position. The stopper is connected to the trigger lever and configured such that at least a portion of the stopper protrudes through the stopper opening and into the hollow interior when the torsion spring is in the relaxed position and recedes through the stopper opening and exits the hollow interior when the torsion spring is in the tensioned position.

In some embodiments, the shaft hollow interior has a diameter between 10 mm and 50 mm. In certain aspects, the shaft has a length between 50 mm and 200 mm. In certain embodiments, the torsion spring includes a coil and a spring end, wherein the coil is attached to the grip member, and wherein the spring end is attached to the trigger lever. In some aspects, the grip member includes one or more grooves or protuberances configured to accommodate one or more fingers of a user when the grip member is held by the user. In some embodiments, the trigger lever includes one or more grooves configured to accommodate one or more fingers of a user when the grip member is held by the user. In certain aspects, the grip member includes a rubber material positioned at one or more exterior surface regions of the grip member.

Also provided is a paintball marker including a rotatable forward grip component proximate to a muzzle end of the paintball marker. The forward grip component includes a cylindrical shaft, a grip member, a torsion spring, a trigger lever, and a stopper. The cylindrical shaft has a first longitudinal opening at a first longitudinal end, a second longitudinal opening at an opposite second longitudinal end, a stopper opening in a radial wall, and a hollow interior connecting the first and second longitudinal openings and the stopper opening. A portion of the muzzle end of the paintball marker is within the hollow interior. The grip member is connected to the radial wall of the shaft proximate to the stopper opening. The torsion spring is connected to and within the grip member. The trigger lever is connected to the torsion spring and configured to move the torsion spring from a first tensioned position to a second tensioned position, wherein the second tensioned position is less relaxed than the first tensioned position. The stopper is connected to the trigger lever and configured such that at least a portion of the stopper protrudes through the stopper opening and into the hollow interior and contacts the portion of the muzzle end of the paintball marker when the torsion spring is in the first tensioned position. The stopper is further configured such that the portion of the stopper recedes through the stopper opening and exits the hollow interior and releases the contact between the stopper and the portion of the muzzle end of the paintball marker when the torsion spring is in the second tensioned position.

Also provided is a method of rotating a forward grip component of a paintball marker from a first grip position to a second grip position. The method includes providing a paintball marker including a forward grip component proximate to a muzzle end of the paintball marker. The forward grip component includes a cylindrical wall, a grip member, a torsion spring, a trigger lever, and a stopper. The cylindrical shaft includes a first longitudinal opening at a first longitudinal end, a second longitudinal opening at an opposite second longitudinal end, a stopper opening in a radial wall, and a hollow interior connecting the first and second longitudinal openings and the stopper opening. A portion of the muzzle end of the paintball marker is within the hollow interior. The grip member is connected to a portion of an exterior surface of the radial wall of the shaft proximate to the stopper opening. The torsion spring is connected to and within the grip member and is in a first tensioned position. The trigger lever is connected to the torsion spring. The stopper is connected to the trigger lever, wherein at least a portion of the stopper protrudes through the stopper opening and into the hollow interior. The stopper contacts the portion of the muzzle end of the paintball marker, thereby holding the forward grip component in the first grip position. The method further includes depressing the trigger lever, thereby moving the torsion spring into a second tensioned position, and thereby releasing the contact between the stopper and the portion of the muzzle end of the paintball marker, wherein the second tensioned position is less relaxed (e.g., the torsion spring is in a more compressed state and thus, possesses a higher level of tension) than the first tensioned position. The method further includes rotating the forward grip component about the portion of the muzzle end of the paintball marker to the second grip position. The method further includes releasing the trigger lever, thereby returning the torsion spring to the first tensioned position, thereby restoring contact between the stopper and the portion of the muzzle end of the paintball marker, and thereby holding the forward grip component in the second grip position.

Also provided is a rotatable forward grip attachment for a paintball marker. The forward grip attachment includes a cylindrical adapter, a cylindrical shaft, a grip member, a torsion spring, a trigger lever, and a stopper. The cylindrical adapter has a forward section proximate to a first longitudinal end, and a rear section proximate to an opposite second longitudinal end. The cylindrical adapter further includes a first longitudinal opening at the first longitudinal end, a second longitudinal opening at the second longitudinal end, a stopper opening in a radial wall, and a hollow interior connecting the first and second longitudinal openings and the stopper opening. The cylindrical adapter further includes an exterior groove extending along at least a portion of an outer circumference of the forward section, an interior threaded region on an interior surface of the forward section, and an exterior threaded region on an exterior surface of the rear section. The cylindrical shaft encircles at least a portion of the forward section of the cylindrical adapter and has a first exterior ridge configured to mate with the exterior groove of the adapter. The grip member is connected to the shaft. The torsion spring is connected to and within the grip member. The trigger lever is connected to the torsion spring and configured to move the torsion spring from a relaxed position to a tensioned position. The stopper is connected to the trigger lever, and is configured such that at least a portion of the stopper protrudes through the stopper opening and into the hollow interior when the torsion spring is in the relaxed position, and recedes through the stopper opening and exits the hollow interior when the torsion spring is in the tensioned position.

In some embodiments, the adapter hollow interior has a diameter between 10 mm and 50 mm. In certain aspects, the adapter has a length between 50 mm and 200 mm. In certain embodiments, the torsion spring includes a coil and a spring end, wherein the coil is attached to the grip member, and wherein the spring end is attached to the trigger lever. In some aspects, the grip member includes one or more grooves or protuberances configured to accommodate one or more fingers of a user when the grip member is held by the user. In some embodiments, the trigger lever includes one or more grooves configured to accommodate one or more fingers of a user when the grip member is held by the user. In certain aspects, the grip member includes a rubber material positioned at one or more exterior surface regions of the grip member.

Also provided is a paintball marker kit including a paintball marker, a barrel, and a forward grip attachment. The forward grip attachment includes a cylindrical adapter, a cylindrical shaft, a grip member, a torsion spring, a trigger lever, and a stopper. The cylindrical adapter includes a forward section proximate to a first longitudinal end, and a rear section proximate to an opposite second longitudinal end. The cylindrical adapter further includes a first longitudinal opening at the first longitudinal end, a second longitudinal opening at the second longitudinal end, a stopper opening in a radial wall of the forward section, and a hollow interior connecting the first and second longitudinal openings and the stopper opening. The cylindrical adapter further includes an exterior groove extending along at least a portion of an outer circumference of the forward section, an interior threaded region on an interior surface of the forward section and engaged with a threaded region of the barrel, and an exterior threaded region on an exterior surface of the rear section and engaged with a threaded region of the paintball marker. The cylindrical shaft encircles at least a portion of the forward section of the cylindrical adapter and has a first exterior ridge configured to mate with the exterior groove of the adapter. The grip member is connected to the shaft. The torsion spring is connected to and within the grip member. The trigger lever is connected to the torsion spring and configured to move the torsion spring from a first tensioned position to a second tensioned position, wherein the second tension position is less relaxed (e.g., the torsion spring is in a more compressed state and thus, possesses a higher level of tension) than the first tensioned position. The stopper is connected to the trigger lever and configured such that at least a portion of the stopper protrudes through the stopper opening and into the hollow interior and contacts the barrel when the torsion spring is in the first tensioned position. The stopper is further configured such that the portion of the stopper recedes through the stopper opening and exits the hollow interior and releases the contact between the stopper and barrel when the torsion spring is in the second tensioned position.

Also provided is a method of rotating a forward grip attachment of a paintball marker kit from a first grip position to a second grip position. The method includes providing the paintball marker kit, including a paintball marker, a barrel, and the forward grip attachment. The forward grip attachment includes a cylindrical adapter, a cylindrical shaft, a grip member, a torsion spring, a trigger lever, and a stopper. The cylindrical adapter includes a forward section proximate to a first longitudinal end, and a rear section proximate to an opposite second longitudinal end. The cylindrical adapter further includes a first longitudinal opening at the first longitudinal end, a second longitudinal opening at the second longitudinal end, a stopper opening in a radial wall of the forward section, and a hollow interior connecting the first and second longitudinal openings and the stopper opening. The cylindrical adapter further includes an exterior groove extending along at least a portion of the outer circumference of the forward section, an interior threaded region on an interior surface of the forward section and engaged with a threaded region of the barrel, and an exterior threaded region on an exterior surface of the rear section and engaged with a threaded region of the paintball marker. The cylindrical shaft encircles at least a portion of the forward section of the cylindrical adapter and has a first exterior ridge configured to mate with the exterior groove of the adapter. The grip member is connected to the shaft. The torsion spring is connected to and within the grip member. The trigger lever is connected to the torsion spring and configured to move the torsion spring from a first tensioned position to a second tensioned position, wherein the second tensioned position is less relaxed than the first tensioned position. The stopper is connected to the trigger lever, wherein at least a portion of the stopper protrudes through the stopper opening and into the hollow interior, and wherein the stopper contacts the barrel, thereby holding the forward grip attachment in the first position. The method further includes depressing the trigger lever, thereby moving the torsion spring into a second tensioned position, and thereby releasing the contact between the stopper and barrel, wherein the second tensioned position is less relaxed than the first tensioned position. The method further includes rotating the shaft about the adapted, thereby moving the forward grip attachment to the second grip position. The method further includes releasing the trigger lever, thereby returning the torsion spring to the first tensioned position, and thereby holding the forward grip attachment in the second grip position.

Also provided is a repositionable and rotatable forward grip component of a paintball marker. The forward grip component includes a cylindrical shaft, a swivel adapter, and a grip member. The cylindrical shaft includes a first longitudinal opening at a first longitudinal end, a second longitudinal opening at an opposite second longitudinal end, and a hollow interior connecting the first and second longitudinal ends. The swivel adapter encircles a portion of the shaft and can freely rotate about the shaft. The grip member is connected to the swivel adapter and includes a grip opening at a grip member end. The grip opening is configured to receive the swivel adapter upon retraction of the swivel adapted within a hollow grip interior of the grip member.

In some embodiments, the forward grip component further includes a collar encircling a portion of the shaft, and a tightening screw passing through the collar towards a radial wall of the shaft. In certain aspects, the swivel adapter includes a first loop and a second loop, wherein the first and second loops encircle the shaft on opposite sides of the portion encircled by the collar. In certain embodiments, the swivel adapter further includes a slide tab protruding through a slide slit of the grip member, wherein movement of the slide tab along the slide slit towards the grip end causes the extension of the swivel adapter out of the hollow grip interior, and wherein movement of the slide tab along the slide slit away from the grip end causes the retraction of the swivel adapter within the hollow grip interior. In some aspects, the forward grip component further includes a pair of lock stoppers within the hollow grip interior, and a lock tab connected to the lock stoppers and protruding through a lock slit of the grip member, wherein movement of the lock tab along the lock slit causes at least one of the lock stoppers to initiate or release contact with the swivel adapter.

Also provided is a paintball marker including a repositionable and rotatable forward grip component releasably connected to a post proximate to a muzzle end of the paintball marker. The forward grip component includes a cylindrical shaft, a swivel adapter, and a grip member. The cylindrical shaft has a first longitudinal opening at a first longitudinal end, a second longitudinal opening at an opposite second longitudinal end, and a hollow shaft interior connecting the first and second longitudinal ends. The swivel adapter encircles a portion of the shaft and can freely rotate about the shaft. The grip member is connected to the swivel adapter and includes a grip opening at a grip member end. The grip opening is configured to receive the swivel adapter upon retraction of the swivel adapter upon retraction of the swivel adapter within a hollow grip interior of the grip member.

In some embodiments, the forward grip component further includes a collar encircling a portion of the shaft, and a tightening screw passing through the collar towards a radial wall of the shaft. In certain aspects, the swivel adapter includes a first loop and a second loop, wherein the first and second loops encircle the shaft on opposite sides of the portion encircled by the collar. In certain embodiments, the swivel adapter further includes a slide tab protruding through a slide slit of the grip member, wherein movement of the slide tab towards the grip end causes the extension of the swivel adapter out of the hollow grip interior, and wherein movement of the slide tab along the slide slit away from the grip end causes the retraction of the swivel adapter within the hollow grip interior. In some aspects, the forward grip component further includes a pair of lock stoppers within the hollow grip interior, and a lock tab connected to the lock stoppers and protruding through a lock slit of the grip member, wherein movement of the lock tab along the lock slit causes at least one of the lock stoppers to initiate or release contact with the swivel adapter.

Also provided is a method of repositioning a rotatable forward grip component of a paintball marker. The method includes providing a paintball marker kit including the paintball marker, a barrel connected to the paintball marker, and the forward grip component, wherein the forward grip component is releasably connected to a post that is proximate to a muzzle end of the paintball marker. The forward grip component includes a cylindrical shaft, a swivel adapter, and a grip member. The cylindrical shaft has a first longitudinal opening at a first longitudinal end, a second longitudinal opening at an opposite second longitudinal end, and a hollow shaft interior connecting the first and second longitudinal ends. The swivel adapter encircles a portion of the shaft and can freely rotate about the shaft. The grip member is connected to the swivel adapter, wherein the swivel adapter is within a hollow grip interior of the grip member. The method further includes detaching the forward grip component from the post. The method further includes extending the swivel adapter from the grip member. The method further includes inserting the barrel through the hollow shaft interior.

In some embodiments, the forward grip component further includes a collar encircling a portion of the shaft, and a tightening screw passing through the collar towards a radial wall of the shaft, and the method further includes tightening the tightening screw, thereby pressing the shaft against the barrel. In certain aspects, the swivel adapter includes a first loop and a second loop, wherein the first and second loops encircle the shaft on opposite sides of the portion encircled by the collar. In certain embodiments, the swivel adapter further includes a slide tab protruding through a slide slit of the grip member, and the extending of the swivel adapter includes moving the slide tab along the slide slit towards the grip end. In some aspects, the forward grip member further includes a pair of lock stoppers within the hollow grip interior, and a lock tab connected to the lock stoppers and protruding through a lock slit of the grip member, wherein the extending of the swivel adapter includes moving the lock tab along the lock slit, thereby initiating contact between at least one of the lock stoppers and the swivel adapter.

DETAILED DESCRIPTION

In one aspect, a rotatable forward grip component of a paintball marker is disclosed. The grip component can be rotated (e.g., from a first position to a second position) about a portion of the muzzle end of the paintball marker. Through this rotation, an operator of the paintball marker can move other components (e.g., a hopper) of the paintball marker away from his or her line of sight to a target. A stopper and torsion spring of the grip component can allow the grip to be held at the starting (e.g., first) and end (e.g., second) positions of the rotation before and after the rotation.

Figure 1:
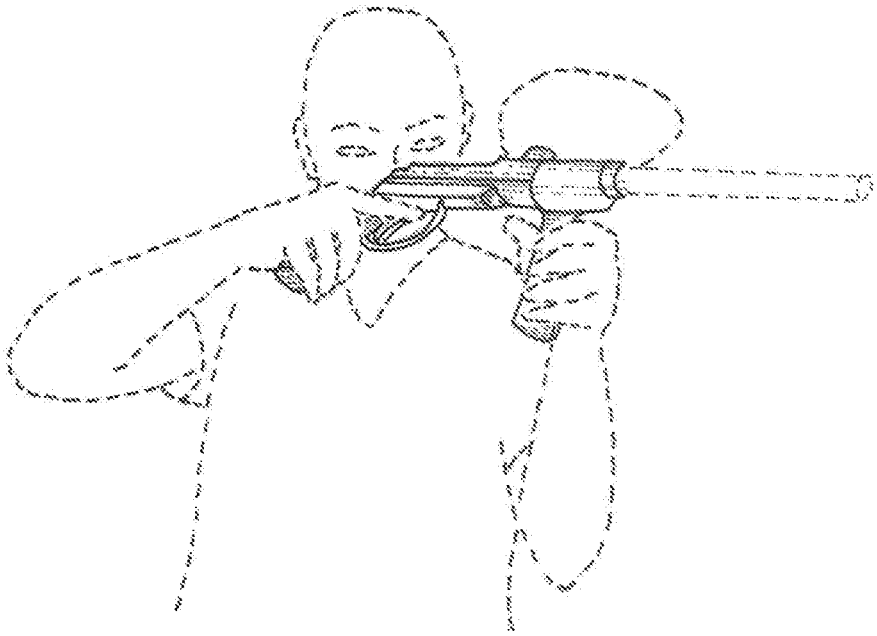
FIG. 1 is a perspective angled frontal view of a person holding a paintball marker with a rotatable forward grip component rotated clockwise in accordance with an embodiment.
Figure 2:
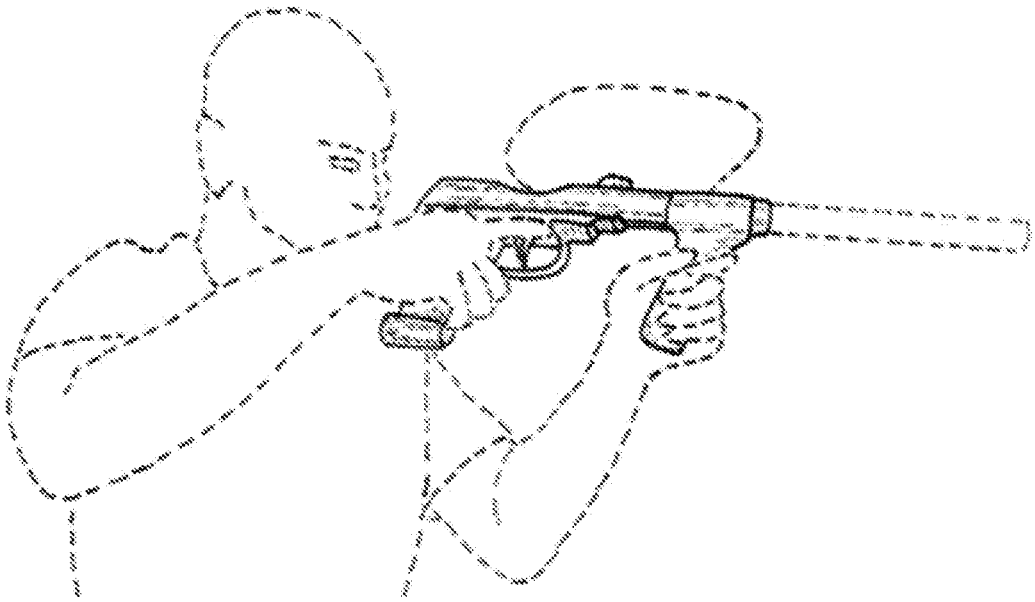
FIG. 2 is a perspective side view of the person and paintball marker of FIG. 1.
Figure 3:
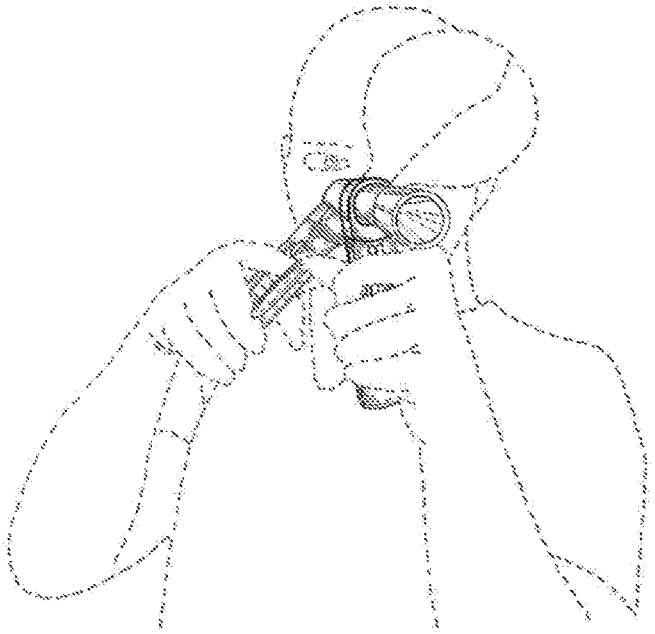
FIG. 3 is perspective frontal view of the person and paintball marker of FIGS. 1 and 2.

FIGS. 1-3 illustrate the use of a provided paintball marker that includes a rotatable forward grip as disclosed herein. Each of the illustrations depicts a different perspective view of a person holding the paintball marker in an orientation in which the grip and the marker body are rotated relative to one another. Specifically, the forward grip of the marker in FIGS. 1-3 has been rotated clockwise relative to the paintball marker body and hopper, and the body and hopper have been rotated counterclockwise relative to the forward grip. As used herein, the terms "clockwise" and "counterclockwise" refer to rotational directions from the perspective of the user of the paintball marker. Because of the relative rotation of the grip with respect to the other paintball marker components, the person depicted in FIGS. 1-3 can have a clearer line of sight to a target being aimed at. This effect can be seen in particular in FIG. 3, in which the right eye of the person is positioned proximate to the breech end of the marker and is visible from the illustrated perspective of the muzzle end of the marker (e.g., from a perspective at or near the target). In contrast, if the marker body and the forward grip were not rotated relative to one another, then the hopper would be in its original position, in substantially the same plane as the forward grip, and blocking the line of sight leading from the right eye of the person to the target.

Figure 4:
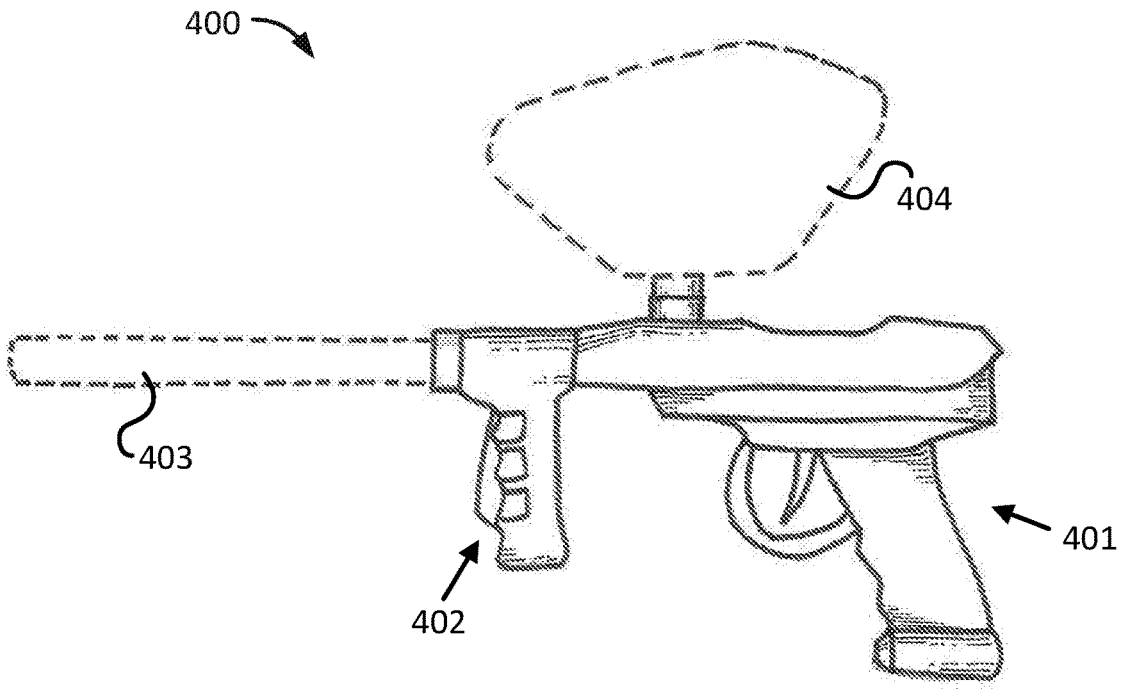
FIG. 4 is perspective side view of a paintball marker with a rotatable forward grip component in accordance with an embodiment.

FIG. 4 provides a side view of the paintball marker (400) of FIGS. 1-3. The paintball marker body (401) and the rotatable forward grip component (402) are illustrated with solid lines, and the removable and attachable components of the paintball marker barrel (403) and the hopper (404) are illustrated with dashed lines. The components of the marker as shown in FIG. 4 are in a neutral position, in which the forward grip, the barrel, and the hopper each extend outward from the body in directions that are substantially in the same plane.

Figure 5:
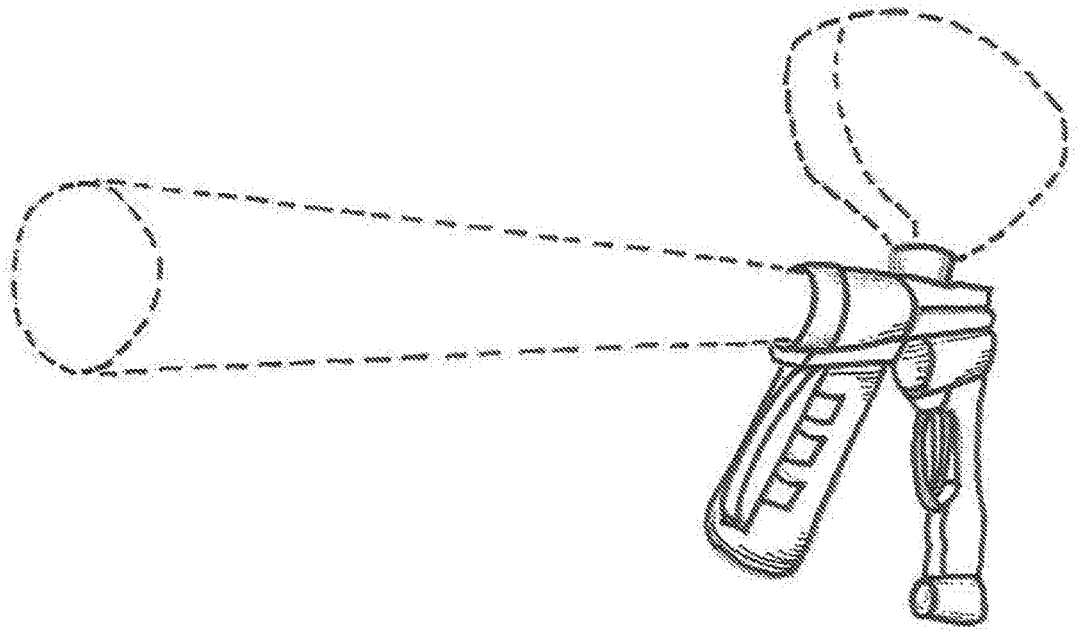
FIG. 5 is a perspective angled front view of the paintball marker of FIG. 4.
Figure 6:
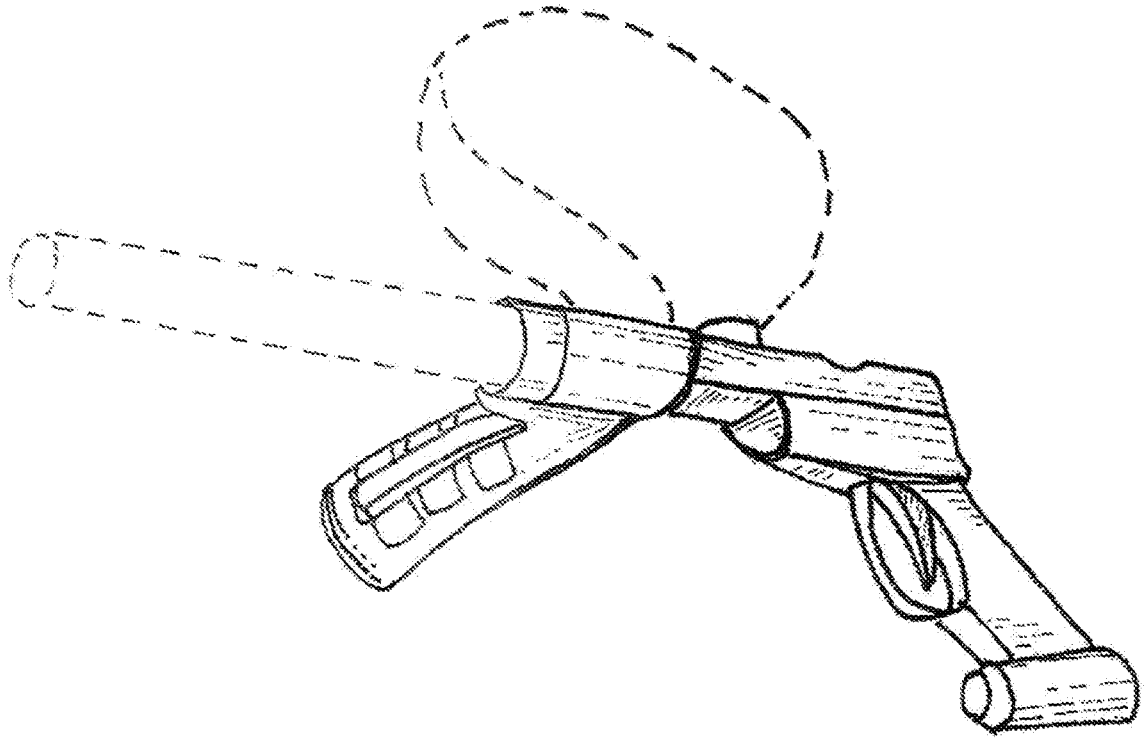
FIG. 6 is a perspective angled side view of the paintball marker of FIGS. 4 and 5 with the rotatable forward grip component rotated counterclockwise.
Figure 7:
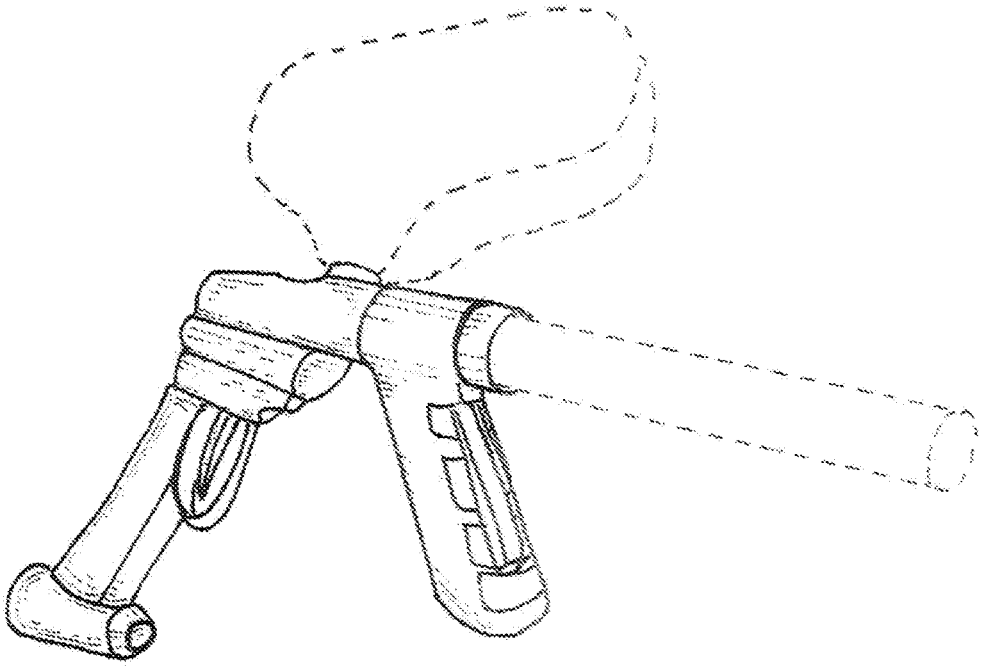
FIG. 7 is a perspective angled side view of the paintball marker of FIGS. 4-6 with the rotatable forward grip component rotated clockwise.
Figure 8:
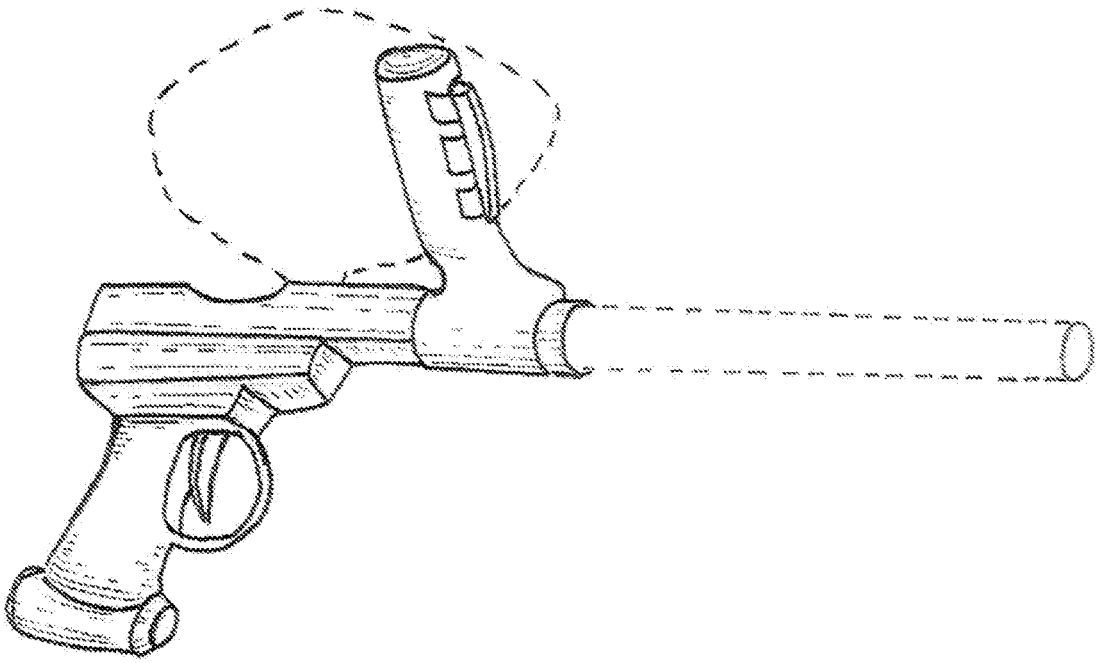
FIG. 8 is a perspective angled side view of the paintball marker of FIGS. 4-7 with the rotatable forward grip component rotated farther counterclockwise.

The illustrations of FIGS. 5-8 each show the paintball marker of FIG. 4 with the forward grip rotated away from this neutral position, such that the grip no longer lies substantially within the plane defined by the paintball marker body, barrel, and hopper. In FIG. 5, the forward grip is depicted rotated slightly counterclockwise relative to the paintball marker body. In FIG. 6, the forward grip is rotated further (approximately 90°) in the counterclockwise direction, such that the plane of the forward grip is approximately orthogonal to the plane of the body and hopper. In FIG. 7, the forward grip is depicted rotated slightly clockwise relative to the paintball marker body. In FIG. 8, the forward grip is depicted rotated more than 90° in the counterclockwise direction. In certain aspects, the maximum rotation of the forward grip component relative to the paintball marker body is greater than 36°, e.g., greater than 72°, greater than 108°, greater than 144°, greater than 180°, greater than 216°, greater than 252°, greater than 288°, or greater than 324°. In certain aspects, the forward grip can rotate substantially the amount in both the clockwise and the counterclockwise directions. In some embodiments, the forward grip component can freely rotate 360° around the paintball marker body.

Figure 9:
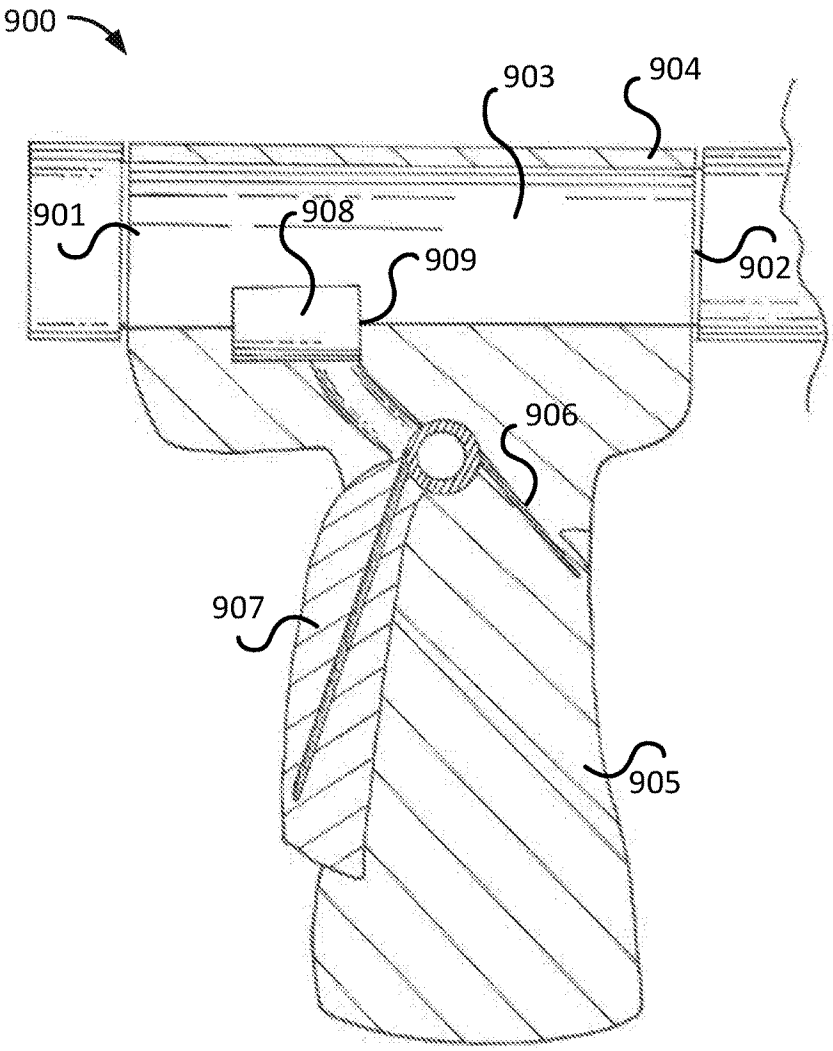
FIG. 9 is a perspective cross section view of a rotatable forward grip component in accordance with an embodiment.

FIG. 9 illustrates some of the elements of an exemplary provided rotatable forward grip paintball marker component in a side cross section view. Shown in the figure is a rotatable forward grip component (900) that includes a cylindrical shaft having a first longitudinal opening (901) and a second longitudinal opening (902), located at opposite longitudinal ends of the shaft from one another. The longitudinal openings are connected via a hollow interior (903) that is defined by a radial wall (904). A grip member (905) is connected to the shaft radial wall and contains a torsion spring (906) that is connected to and within the grip member. The torsion spring is also connected to a trigger lever (907) that is configured to move the torsion spring from a relaxed position (e.g., is not in a compressed state) to a tensioned position (e.g., a compressive force has been applied). A stopper (908) is connected to the trigger lever, wherein the configuration of the stopper, the trigger lever, and the torsion spring is such that the stopper protrudes through a stopper opening (909) in the shaft radial wall, and into the shaft hollow interior, when the torsion spring is in its relaxed position. The forward grip component is shown in FIG. 9 with the trigger lever of the grip member not depressed. This permits the torsion spring to be in its relaxed position, with the connected stopper protruding into the shaft hollow interior.

Figure 10:
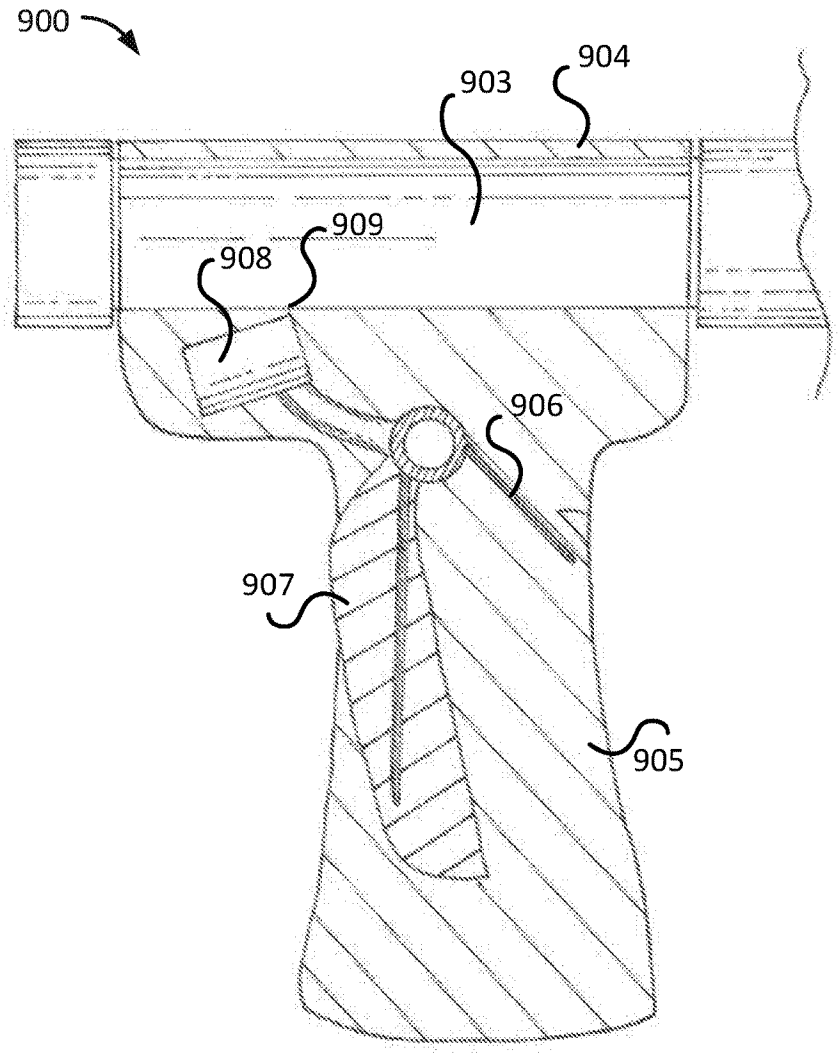
FIG. 10 is a perspective cross section view of the rotatable forward grip component of FIG. 9 with the trigger lever depressed.

FIG. 10 illustrates the rotatable forward grip component (900) of FIG. 9 with the trigger lever (907) depressed, moving the connected torsion spring (906) to a tensioned position. The depression of the trigger lever also moves the stopper (908) through the stopper opening (909) of the cylindrical shaft radial wall (904). In this way, the stopper travels from a position within the shaft hollow interior (903) to one within the grip member (905).

The cylindrical shaft of the rotatable forward grip component can have an axial length that is, for example, between 50 mm and 200 mm, e.g., between 50 mm and 140 mm, between 65 mm and 155 mm, between 80 mm and 170 mm, between 95 mm and 185 mm, or between 110 mm and 200 mm. In terms of upper limits, the shaft length can be less than 200 mm, e.g., less than 185 mm, less than 170 mm, less than 155 mm, less than 140 mm, less than 125 mm, less than 110 mm, less than 95 mm, less than 80 mm, less than 65 mm. In terms of lower limits, the shaft length can be greater than 50 mm, e.g., greater than 65 mm, greater than 80 mm, greater than 95 mm, greater than 110 mm, greater than 125 mm, greater than 140 mm, greater than 155 mm, greater than 170 mm, or greater than 185 mm. Larger lengths, e.g., greater than 200 mm, and smaller lengths, e.g., less than 50 mm, are also contemplated.

The hollow interior of the cylindrical shaft, and the first and second longitudinal openings, can each have a diameter that is, for example, between 10 mm and 50 mm, e.g., between 10 mm and 34 mm, between 14 mm and 38 mm, between 18 mm and 42 mm, between 22 mm and 46 mm, or between 26 mm and 50 mm. In terms of upper limits, the shaft hollow interior diameter can be less than 50 mm, e.g., less than 46 mm, less than 42 mm, less than 38 mm, less than 34 mm, less than 30 mm, less than 26 mm, less than 22 mm, less than 18 mm, or less than 14 mm. In terms of lower limits, the shaft hollow interior diameter can be greater than 10 mm, e.g., greater than 14 mm, greater than 18 mm, greater than 22 mm, greater than 26 mm, greater than 30 mm, greater than 34 mm, greater than 38 mm. greater than 42 mm, or greater than 46 mm. Larger diameters, e.g., greater than 50 mm, and smaller diameters, e.g., less than 10 mm, are also contemplated.

The cylindrical shaft radial wall, the grip member, and the trigger lever of the rotatable forward grip component can each be constructed of identical or different materials. The radial wall, the grip member, and the trigger lever can each independently include, for example, one or more metals, one or more rubbers, one or more polymers, or combinations thereof. In some embodiments, the grip member includes a least one rubber material positioned at one or more of its exterior surface regions. This configuration of grip member materials can improve the friction and feel of the grip member when held by a user of the paintball marker that includes the rotatable forward grip component.

Figure 12:
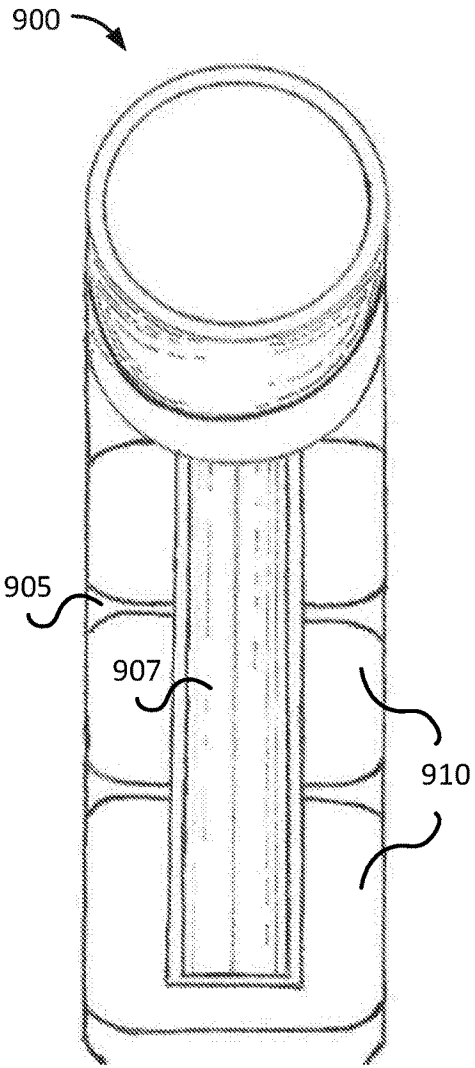
FIG. 12 is a perspective front view of the rotatable forward grip component of FIGS. 9-11 with the trigger lever depressed.
Figure 11:
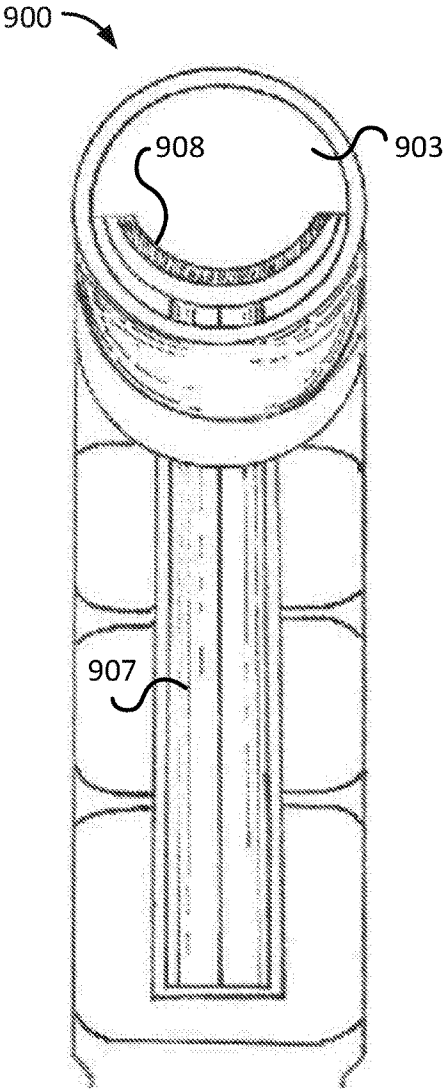
FIG. 11 is a perspective front view of the rotatable forward grip component of FIGS. 9 and 10.

FIG. 11 illustrates a frontal (e.g., muzzle end) view of the rotatable forward grip (900) of FIGS. 9 and 10 with the trigger lever (907) not depressed, resulting in the stopper (908) visibly protruding into the hollow interior (903) of the cylindrical shaft. FIG. 12 illustrates a frontal view of the rotatable forward grip (900) of FIG. 11 with the trigger lever (907) depressed, resulting in the stopper exiting the shaft hollow interior (903) and receding into the grip member (905). In some embodiments, and as is shown in FIGS. 11 and 12, an exterior surface of the grip member includes one or more grooves (910). The grooves can have sizes and shapes configured to accommodate one or more fingers of a user when the grip member is held by a user of the paintball marker. In some embodiments, an exterior surface of the trigger lever includes one or more grooves configured to accommodate the fingers of the user. In certain aspects, the grip member and the trigger lever each include such grooves.

Figure 13:
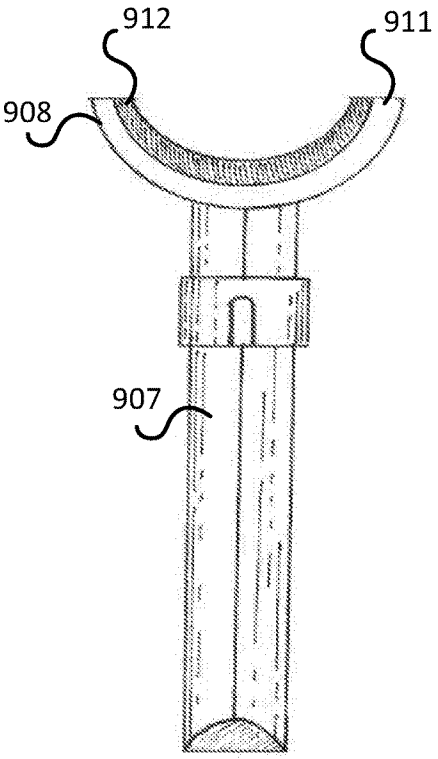
FIG. 13 is a perspective front view of a trigger lever and stopper in accordance with an embodiment.

FIG. 13 illustrates the stopper (908) and connected trigger lever (907) elements of the rotatable forward grip component of FIGS. 9-12, as viewed outside of the grip member that they otherwise at least partially contained within. In some embodiments, and as shown in FIG. 12, the stopper has a shape that is curved. The degree of curvature of the stopper can be substantially similar to that of the cylindrical shaft. The curved shape of the stopper can be selected to increase the contact of the stopper with another paintball marker element (e.g., the paintball marker) that passes through the cylindrical shaft. In some embodiments, and as shown in FIG. 12, the stopper can include two or more different materials. A first region (911) of the stopper can be connected to the trigger lever and can include one or more materials selected for strength and rigidity. The materials of the first region can include, for example, metals, rigid plastics including but not limited to ABS plastic, rigid rubbers including but not limited to vulcanized rubber, woods and wood-based materials, MDF, pressed paper materials, or combinations thereof. A second region (912) of the stopper can be configured to press against a paintball marker element (e.g., the paintball marker body) within the shaft hollow interior and can include materials selected for increased friction and pliability. The materials of the second region can include, for example, elastomeric polymers, natural and synthetic rubbers, silicone-based materials, or combinations thereof.

Also provided are paintball markers that include a rotatable forward grip component as described above. A portion of the muzzle end of the paintball marker (e.g., a portion of the muzzle end of the paintball marker body) can be within the hollow interior of the forward grip component cylindrical shaft. The configuration of the paintball marker portion, the stopper, the trigger lever, and the torsion spring can be such that when the trigger lever is not depressed and the torsion spring is in a first tensioned position, the stopper contacts the paintball marker portion within the cylindrical shaft hollow interior. In some embodiments, the paintball marker (e.g., the paintball marker body) does not contact a portion, a substantial portion, or a majority of the cylindrical shaft radial wall. In this way, it can be the pressure of the stopper against the paintball marker body that prevents rotation of the paintball marker body within the hollow interior of the rotatable forward grip component.

The configuration of the paintball marker elements can also be such that when the trigger lever is depressed and the torsion spring is moved to a second tensioned position that is less relaxed than the first tensioned position, the stopper releases contact with the paintball marker portion. The stopper can further exit the cylindrical shaft hollow interior and recede into the grip member when the torsion spring is in the second tensioned position. In this way, the depressing of the trigger lever relieves the pressure applied on the paintball marker body by the stopper and permits the paintball marker body to rotate within the cylindrical shaft hollow interior.

Once the paintball marker and the forward grip component have been rotated relative to one another (e.g., from a first grip position to a second grip position), the depressed trigger lever can be released. The release of the trigger lever can allow the torsion spring to return to its first tensioned position, and the stopper to return to the cylindrical shaft hollow interior. This can restore the contact between the stopper and the portion of the muzzle end of the paintball marker (body) and can hold the rotatable forward grip component in the new (e.g., second) grip position about the paintball marker body.

Figure 14:
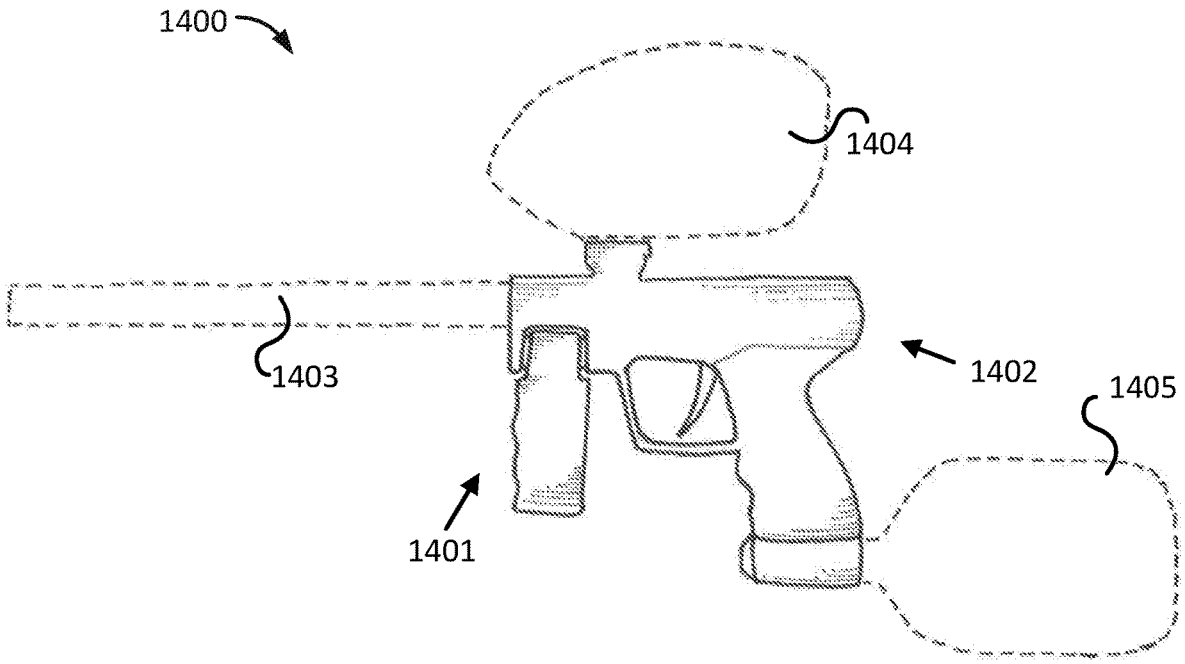
FIG. 14 is a perspective side view of a paintball marker with a rotatable forward grip component in accordance with an embodiment.

FIG. 14 illustrates another exemplary embodiment of a paintball marker (1400) that includes a rotatable forward grip component (1401) as disclosed herein. The paintball marker body (1402) and the rotatable forward grip component are illustrated with solid lines, and the removable and attachable components of the paintball marker barrel (1403), the hopper (1404), and the propellant tank (1405) are illustrated with dashed lines. The components of the marker as shown in FIG. 14 are in a neutral position, in which the forward grip, the barrel, and the hopper each extend outward from the body in directions that are substantially in the same plane. In the paintball marker of FIG. 14, and in contrast with the paintball marker of FIGS. 1-8, the portion of the paintball marker body that is within a cylindrical shaft hollow interior of the rotatable forward grip component is not substantially coaxial with the paintball marker barrel. Instead, the body portion within the cylindrical shaft hollow interior of FIG. 14 is offset below the longitudinal axis of the barrel from the perspective of the operator of the paintball marker. Furthermore, in some embodiments, the rotatable forward grip component does not include a stopper, trigger lever, and torsion spring. In these embodiments, the forward grip can be freely pivoted with respect to the paintball marker body without being held at one or more grip positions during the rotation.

In another aspect, a rotatable forward grip attachment for a paintball marker is disclosed. The grip attachment can be rotated (e.g., from a first position to a second position) about a portion of the breech end of the paintball marker barrel. Through this rotation, an operator of the paintball marker can move other components (e.g., a hopper) of the paintball marker away from his or her line of sight to a target. A stopper and torsion spring of the grip component can allow the grip to be held at the starting (e.g., first) and end (e.g., second) positions of the rotation before and after the rotation. The forward grip attachment can be configured to attach to a barrel and body of an existing paintball marker, such that the paintball marker (e.g., a standard or prior art paintball marker) can be retrofitted to include the provided rotatable forward grip attachment and to gain the associated advantages described above.

Figure 15:
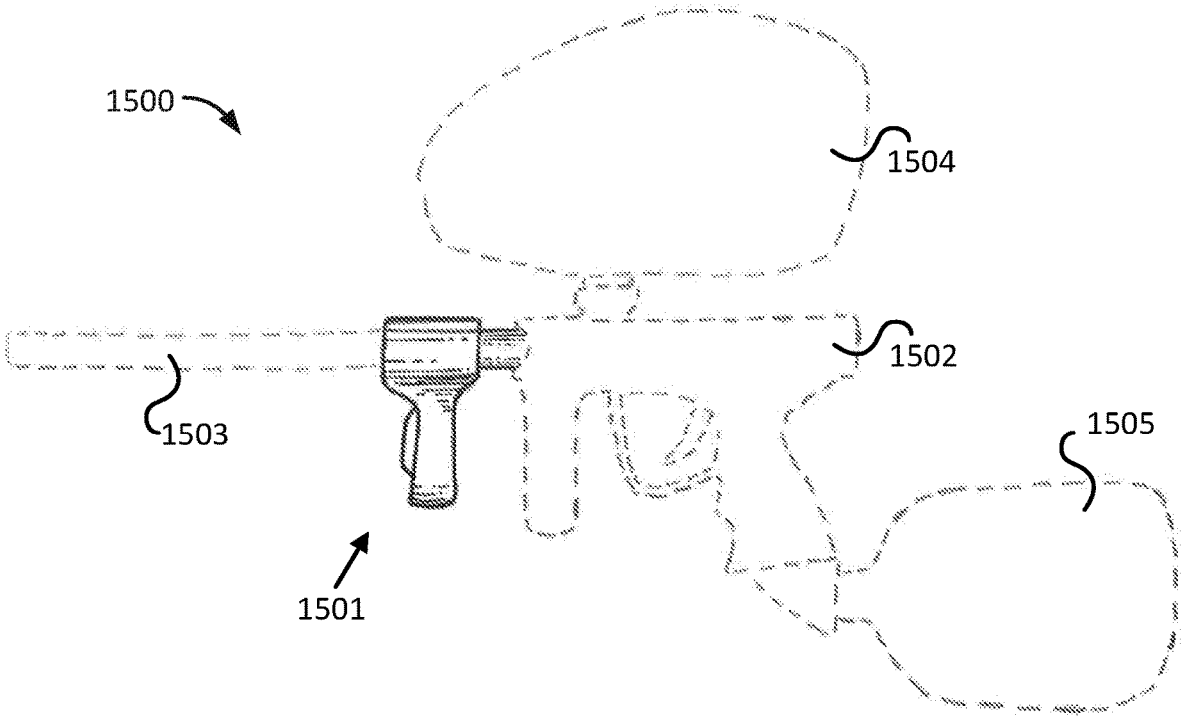
FIG. 15 is perspective side view of a rotatable forward grip attachment for a paintball marker in accordance with an embodiment, depicted connected to a paintball marker and a barrel.

FIG. 15 provides a side view of a paintball marker (1500) that includes a rotatable forward grip attachment (1501) as disclosed herein. The rotatable forward grip attachment is illustrated with solid lines, and the removable and attachable components of the paintball marker body (1502), the paintball marker barrel (1503), the hopper (1504), and the propellant tank (1505) are illustrated with dashed lines. The components of the marker as shown in FIG. 15 are in a neutral position, in which the forward grip, the barrel, and the hopper each extend outward from the body in directions that are substantially in the same plane.

Figure 17:
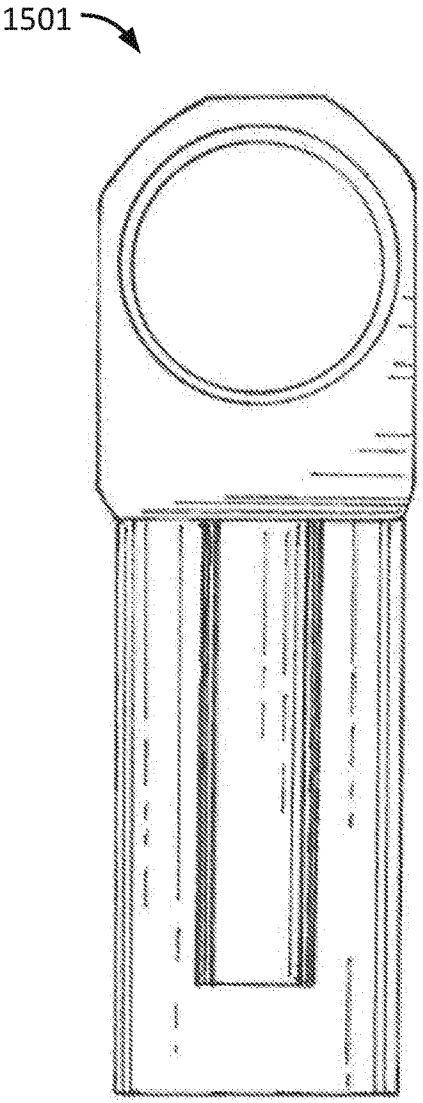
FIG. 17 is a perspective side view of the rotatable forward grip attachment of FIG. 16.
Figure 16:
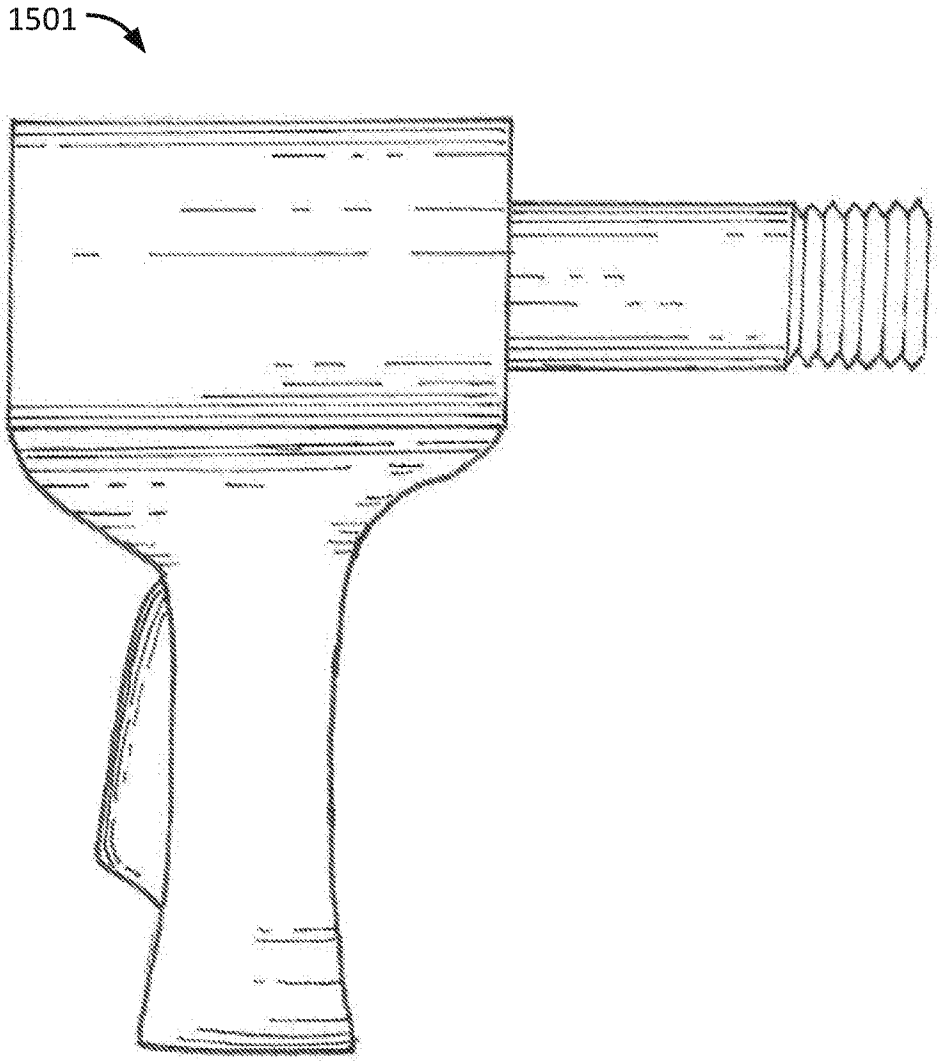
FIG. 16 is a perspective side view of the rotatable forward grip attachment of FIG. 15.

The illustrations of FIGS. 16 and 17 each show the rotatable forward grip attachment (1501) of FIG. 15 detached from the other elements of the paintball marker. FIG. 16 provides a side view of the forward grip attachment, and FIG. 17 provides a frontal (e.g., muzzle end) view of the forward grip attachment.

Figure 18:
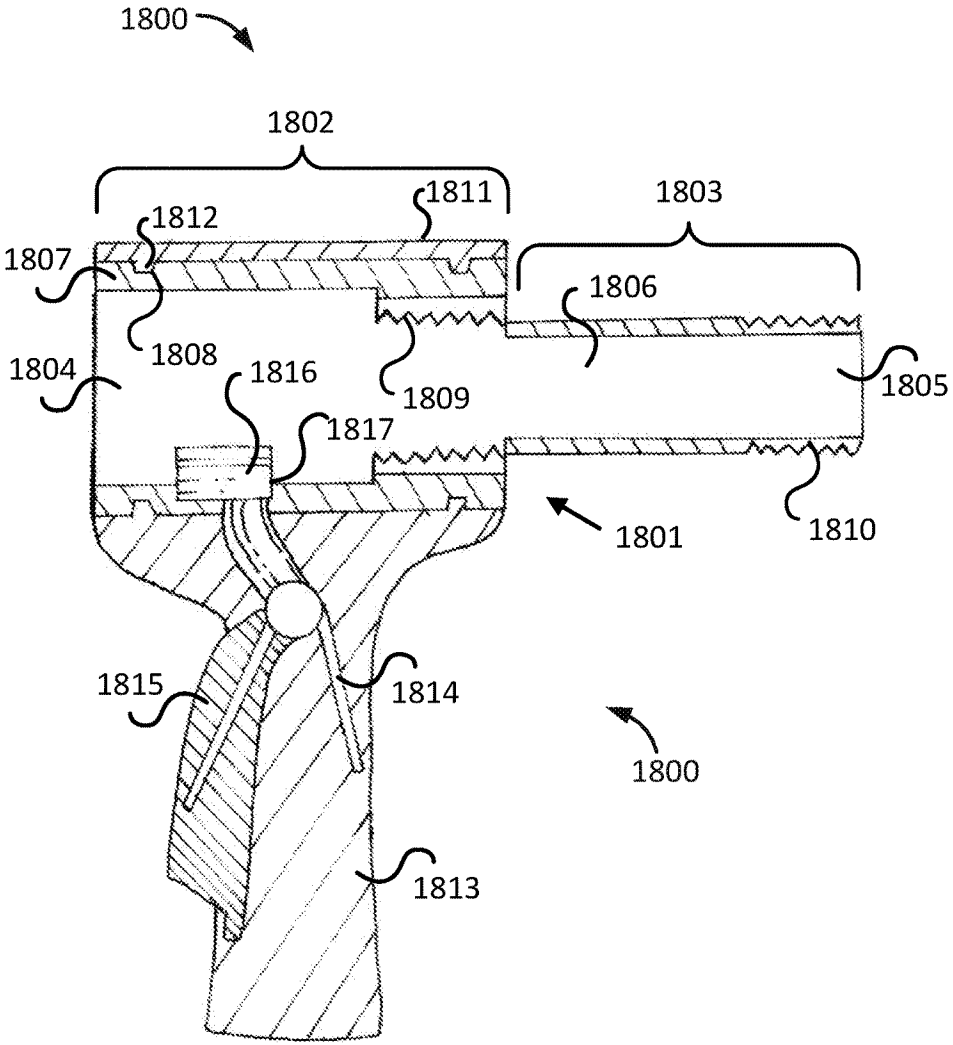
FIG. 18 is a perspective cross section of a rotatable forward grip attachment in accordance with an embodiment.

FIG. 18 illustrates some of the elements of an exemplary provided rotatable forward grip paintball marker attachment in a side cross section view. Shown in the figure is a rotatable forward grip attachment (1800) that includes a cylindrical adapter (1801) having a forward section (1802) and a rear section (1803) at opposite longitudinal ends of the adapter from one another. A first longitudinal opening (1804) is at the first longitudinal end in the cylindrical adapter forward section and a second longitudinal opening (1805) is at the second longitudinal end in the cylindrical adapter rear section. The longitudinal openings are connected via a hollow interior (1806) that is at least partially defined by a radial wall (1807). The forward section of the cylindrical adapter includes one or more exterior grooves (1808) extending along at least a portion of its outer circumference and an interior threaded region (1809) on at least a portion of its interior surface. The rear section of the cylindrical adapter includes an exterior threaded region (1810) on at least a portion of its exterior surface.

The rotatable forward grip attachment (1800) of FIG. 18 also includes a cylindrical shaft (1811) that encircles at least a portion (e.g., at least a portion of the forward section (1802)) of the cylindrical adapter (1801). The cylindrical shaft includes one or more exterior ridges (1812) configured to mate with the one or more exterior grooves (1808) of the cylindrical adapter. A grip member (1813) is connected to the cylindrical shaft and contains a torsion spring (1814) that is connected to and within the grip member. The torsion spring is also connected to a trigger lever (1815) that is configured to move the torsion spring from a relaxed position to a tensioned position. A stopper (1816) is connected to the trigger lever, wherein the configuration of the stopper, the trigger lever, the torsion spring, and the cylindrical shaft is such that the stopper protrudes through a stopper opening (1817) in the cylindrical adapter radial wall (1807), and into the adapter hollow interior (1806), when the torsion spring is in its relaxed position. The forward grip attachment is shown in FIG. 18 with the trigger lever of the grip member not engaged (e.g., not depressed or squeezed). This permits the torsion spring to be in its relaxed position, with the connected stopper protruding into the adapter hollow interior.

Figure 19:
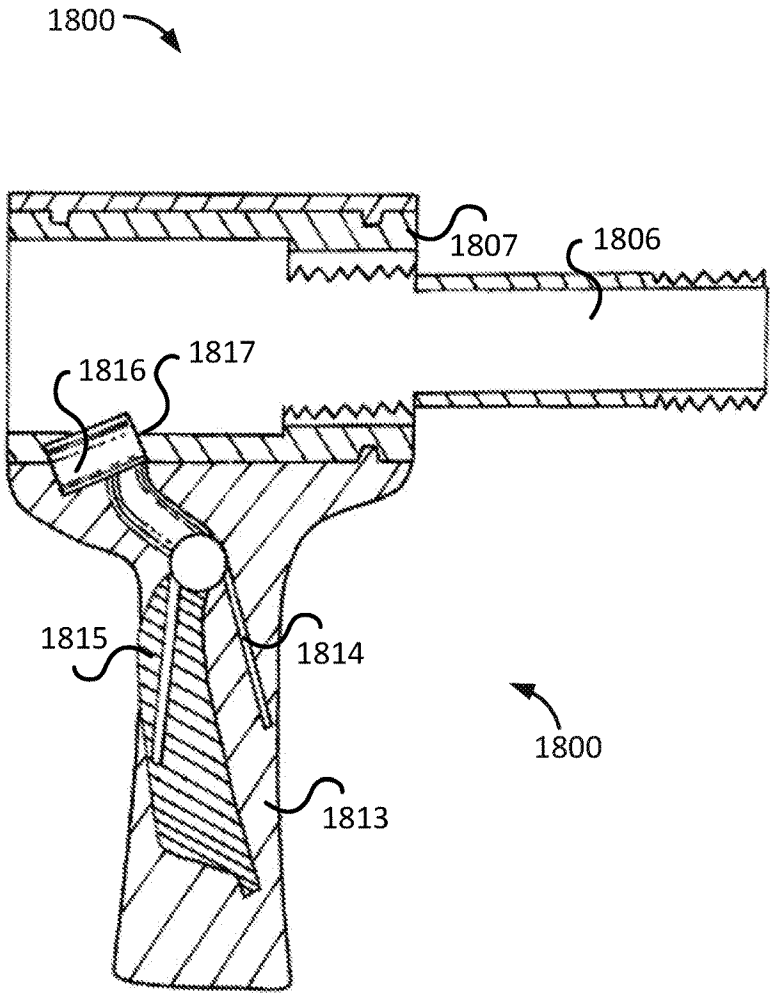
FIG. 19 is a perspective cross section of the rotatable forward grip attachment of FIG. 18 with the trigger lever depressed.

FIG. 19 illustrates the rotatable forward grip component (1800) of FIG. 18 with the trigger lever (1815) depressed, moving the connected torsion spring (1814) to a tensioned position. The depression of the trigger lever also moves the stopper (1816) through the stopper opening (1817) of the cylindrical adapter radial wall (1807). In this way, the stopper travels from a position within the shaft hollow interior (1806) to one within the grip member (1813).

The cylindrical adapter of the rotatable forward grip component can have an axial length that is, for example, between 50 mm and 200 mm, e.g., between 50 mm and 140 mm, between 65 mm and 155 mm, between 80 mm and 170 mm, between 95 mm and 185 mm, or between 110 mm and 200 mm. In terms of upper limits, the adapter length can be less than 200 mm, e.g., less than 185 mm, less than 170 mm, less than 155 mm, less than 140 mm, less than 125 mm, less than 110 mm, less than 95 mm, less than 80 mm, less than 65 mm. In terms of lower limits, the adapter length can be greater than 50 mm, e.g., greater than 65 mm, greater than 80 mm, greater than 95 mm, greater than 110 mm, greater than 125 mm, greater than 140 mm, greater than 155 mm, greater than 170 mm, or greater than 185 mm. Larger lengths, e.g., greater than 200 mm, and smaller lengths, e.g., less than 50 mm, are also contemplated.

The hollow interior of the cylindrical adapter, and the first and second longitudinal openings, can each independently have a diameter that is, for example, between 10 mm and 50 mm, e.g., between 10 mm and 34 mm, between 14 mm and 38 mm, between 18 mm and 42 mm, between 22 mm and 46 mm, or between 26 mm and 50 mm. In terms of upper limits, the adapter hollow interior diameter can be less than 50 mm, e.g., less than 46 mm, less than 42 mm, less than 38 mm, less than 34 mm, less than 30 mm, less than 26 mm, less than 22 mm, less than 18 mm, or less than 14 mm. In terms of lower limits, the adapter hollow interior diameter can be greater than 10 mm, e.g., greater than 14 mm, greater than 18 mm, greater than 22 mm, greater than 26 mm, greater than 30 mm, greater than 34 mm, greater than 38 mm. greater than 42 mm, or greater than 46 mm. Larger diameters, e.g., greater than 50 mm, and smaller diameters, e.g., less than 10 mm, are also contemplated.

The exterior grooves of the cylindrical adapter and the exterior ridges of the cylindrical shaft can be configured to mate with one another such that the adapter and the shaft are capable of rotating with respect to one another but are prevented from translating in a longitudinal direction with respect to one another. The number of grooves and the number of ridges on the adapter and shaft, respectively, can each be, for example, one, two, three, four, five, six, seven, eight, nine, ten, or more than ten.

Figure 20:
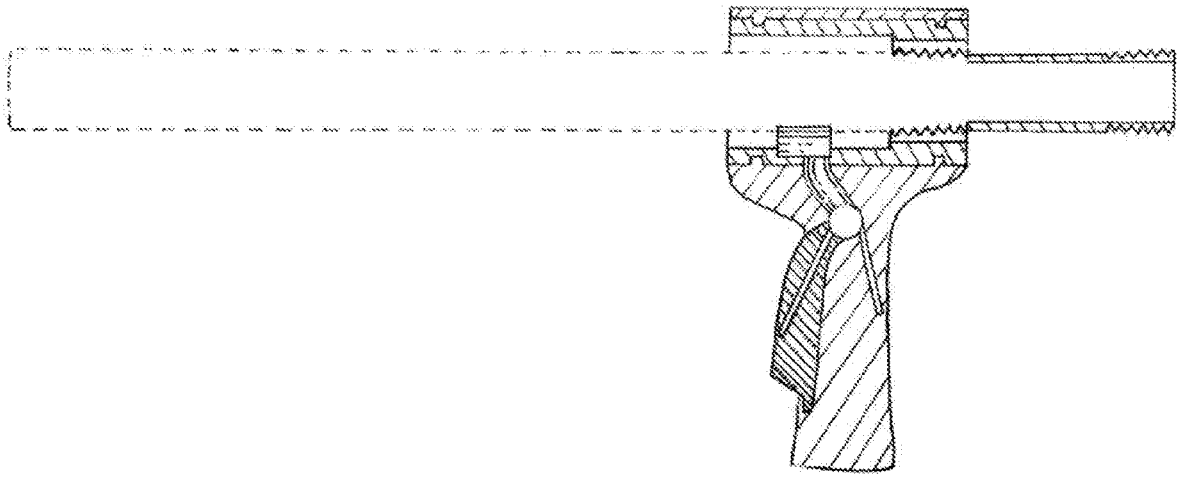
FIG. 20 is a perspective cross section of a rotatable forward grip attachment in accordance with an embodiment, depicted attached to a barrel.

The interior threaded region of the cylindrical adapter forward section can be configured to engage with a threaded region of a paintball marker barrel. The engagement of the adapter internal threaded region with the barrel threaded region can involve inserting a portion of the breech end of the barrel through the first longitudinal opening of the adapter and into the adapter hollow interior. An example of this configuration of a rotatable forward grip attachment and a paintball marker barrel is shown in FIG. 20. In this way a paintball marker barrel that would otherwise be connected (e.g., screwed) directly into a paintball marker body, can instead be connected (e.g., screwed) into the rotatable forward grip attachment cylindrical adapter.

Figure 21:
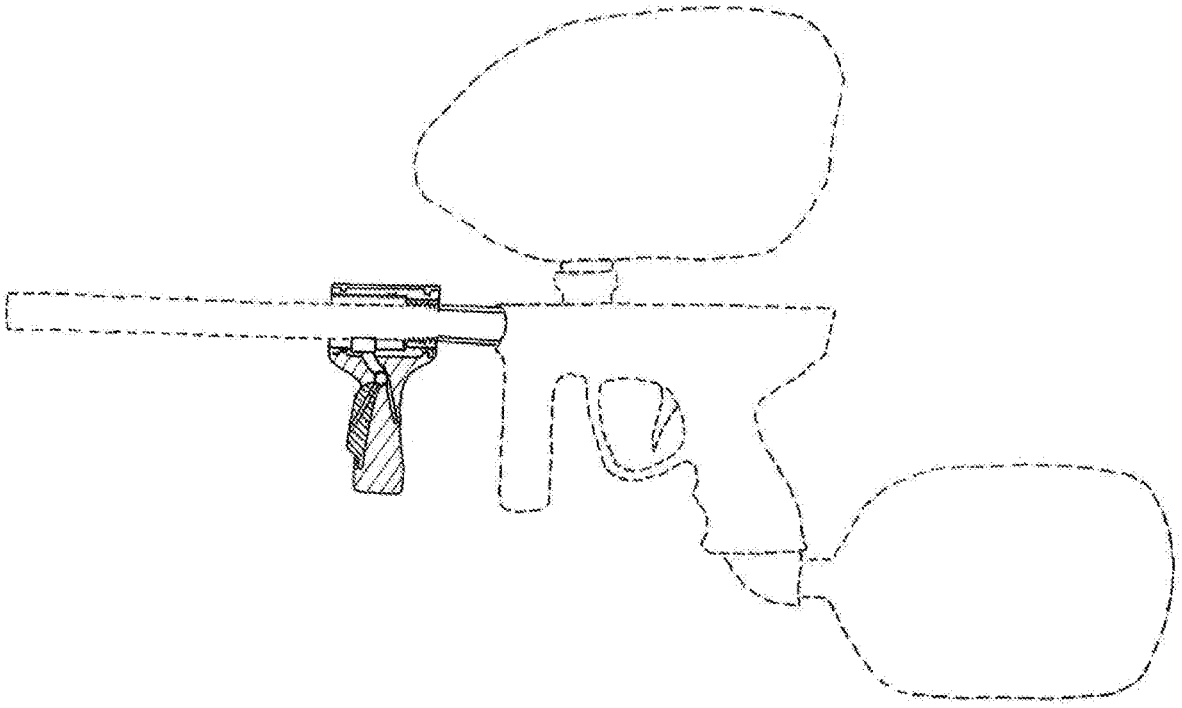
FIG. 21 is a perspective cross section of a rotatable forward grip attachment in accordance with an embodiment, depicted attached to a paintball marker and a barrel.

The exterior threaded region of the cylindrical adapter rear section can be configured to engage with a threaded region of a paintball marker body. The engagement of the adapter exterior threaded region with the body threaded region can involve inserting a portion of the rear section (e.g., the breech end) of the adapter into a muzzle end opening of the body. An example of this configuration of a rotatable forward grip attachment and a paintball marker body is shown in FIG. 21. In this way, a paintball marker body that would otherwise be connected (e.g., screwed) directly into a paintball marker barrel, can instead be connected (e.g., screwed) into the rotatable forward grip attachment cylindrical adapter.

The cylindrical adapter radial wall, the cylindrical shaft, the grip member, and the trigger lever of the rotatable forward grip component can each be constructed of identical or different materials. The radial wall, the shaft, the grip member, and the trigger lever can each independently include, for example, one or more metals, one or more rubbers, one or more polymers, or combinations thereof. In some embodiments, the grip member includes a least one rubber material positioned at one or more of its exterior surface regions. This configuration of grip member materials can improve the friction and feel of the grip member when held by a user of the paintball marker that includes the rotatable forward grip component.

In some embodiments, an exterior surface of the grip member includes one or more grooves. The grooves can have sizes and shapes configured to accommodate one or more fingers of a user when the grip member is held by a user of the paintball marker. In some embodiments, an exterior surface of the trigger lever includes one or more grooves configured to accommodate the fingers of the user. In certain aspects, the grip member and the trigger lever each include such grooves.

In some embodiments, the stopper has a shape that is curved. The degree of curvature of the stopper can be substantially similar to that of the cylindrical adapter. The curved shape of the stopper can be selected to increase the contact of the stopper with another paintball marker element (e.g., the paintball marker barrel) that passes through the cylindrical adapter (e.g., the forward section of the adapter). In some embodiments, the stopper can include two or more different materials. A first region of the stopper can be connected to the trigger lever and can include one or more materials selected for strength and rigidity. The materials of the first region can include, for example, metals, rigid plastics, woods, or combinations thereof. A second region of the stopper can be configured to press against a paintball marker element (e.g., the paintball marker barrel) within the adapter hollow interior and can include materials selected for increased friction and pliability. The materials of the second region can include, for example, elastomeric polymers, rubbers, or combinations thereof.

Also provided are paintball markers that include a rotatable forward grip attachment as described above. A portion of the breech end of the paintball marker body can be within the hollow interior of the forward grip attachment cylindrical adapter, with a threaded region of the barrel engaged with the interior threaded region of the adapter forward section. A portion of the breech end of the forward grip attachment cylindrical adapter can be within the muzzle end of the paintball marker body, with the exterior threaded region of the adapter rear section engaged with a threaded region of the body. The configuration of the paintball marker barrel, the stopper, the trigger lever, and the torsion spring can be such that when the trigger lever is not depressed and the torsion spring is in a first tensioned position, the stopper contacts the barrel portion within the cylindrical adapter hollow interior. In some embodiments, the paintball marker barrel does not contact a portion or a majority of the cylindrical adapter radial wall. In this way, it can be the pressure of the stopper against the paintball marker body that prevents rotation of the paintball marker barrel and the forward grip attachment cylindrical adapter within the cylindrical shaft of the rotatable forward grip attachment.

The configuration of the paintball marker elements can also be such that when the trigger lever is depressed and the torsion spring is moved to a second tensioned position that is less relaxed than the first tensioned position, the stopper releases contact with the paintball marker barrel. The stopper can further exit the cylindrical adapter hollow interior and recede into the grip member when the torsion spring is in the second tensioned position. In this way, the depressing of the trigger lever relieves the pressure applied on the paintball marker barrel by the stopper and permits the forward grip attachment cylindrical shaft to rotate about the forward grip attachment cylindrical adapter.

Once the cylindrical shaft and the cylindrical adapter have been rotated relative to one another (e.g., from a first grip position to a second grip position), the depressed trigger lever can be released. The release of the trigger lever can allow the torsion spring to return to its first tensioned position, and the stopper to return to the cylindrical adapter hollow interior. This can restore the contact between the stopper and the portion of the breech end of the paintball marker barrel and can hold the rotatable forward grip attachment in the new (e.g., second) grip position about the paintball marker barrel.

In another aspect, a repositionable and rotatable forward grip component of a paintball marker is disclosed. The rotatable grip component can be repositioned (e.g., from a first position to a second position) along the same or different elements of the paintball marker. For example, the grip component can be repositioned from the paintball marker body to the paintball marker barrel. In its first position (e.g., attached to the paintball marker body) the forward grip component can be configured to have a stationary orientation, and in its second position (e.g., attached to the paintball maker barrel) the forward grip component can be configured to have a rotatable orientation. Through rotation of the forward grip component once the grip component is at the second position, an operator of the paintball marker can move other components (e.g., a hopper) of the paintball marker away from his or her line of sight to a target.

Figure 22:
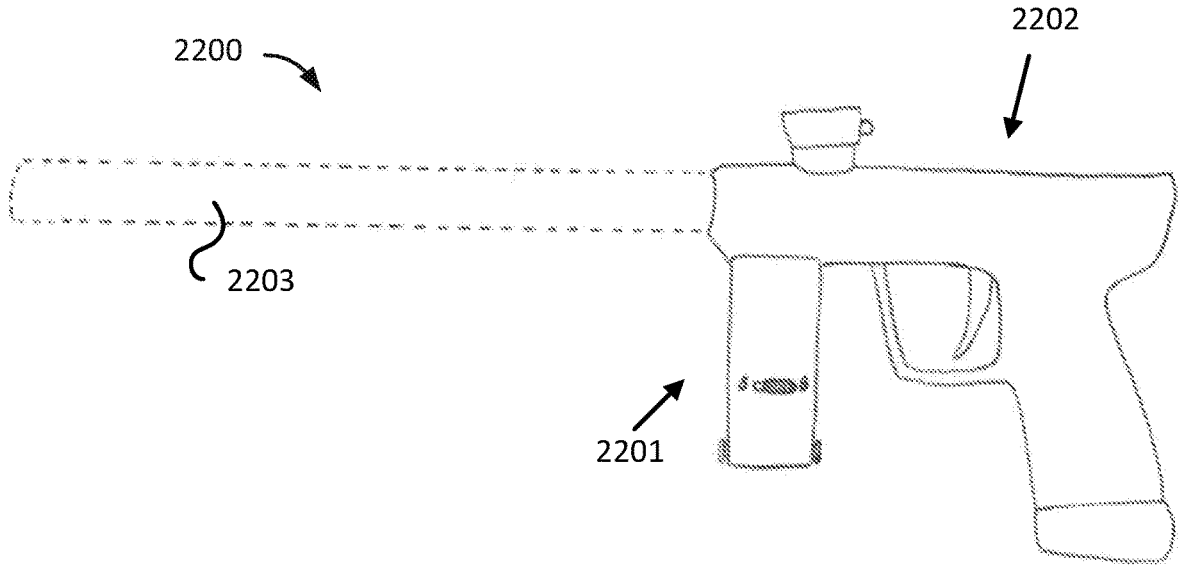
FIG. 22 is a perspective side view of a paintball marker with a repositionable and rotatable forward grip component in accordance with an embodiment.
Figure 23:
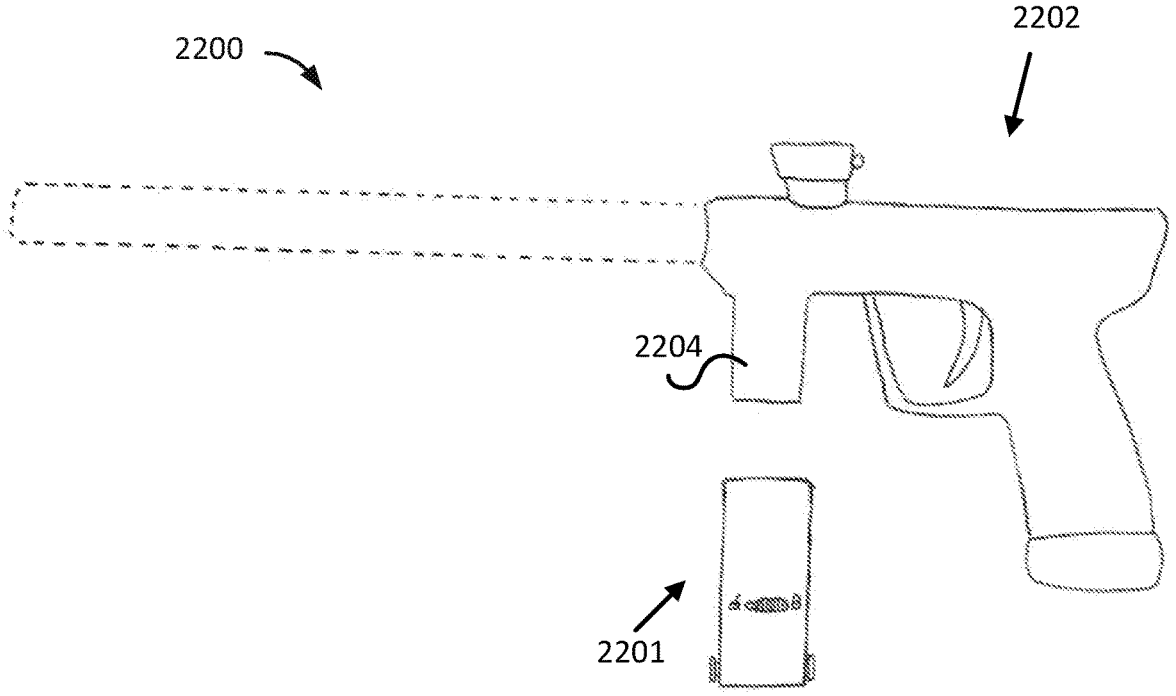
FIG. 23 is a perspective side view of the paintball marker of FIG. 22 with the repositionable and rotatable forward grip component detached from the paintball marker.
Figure 24:
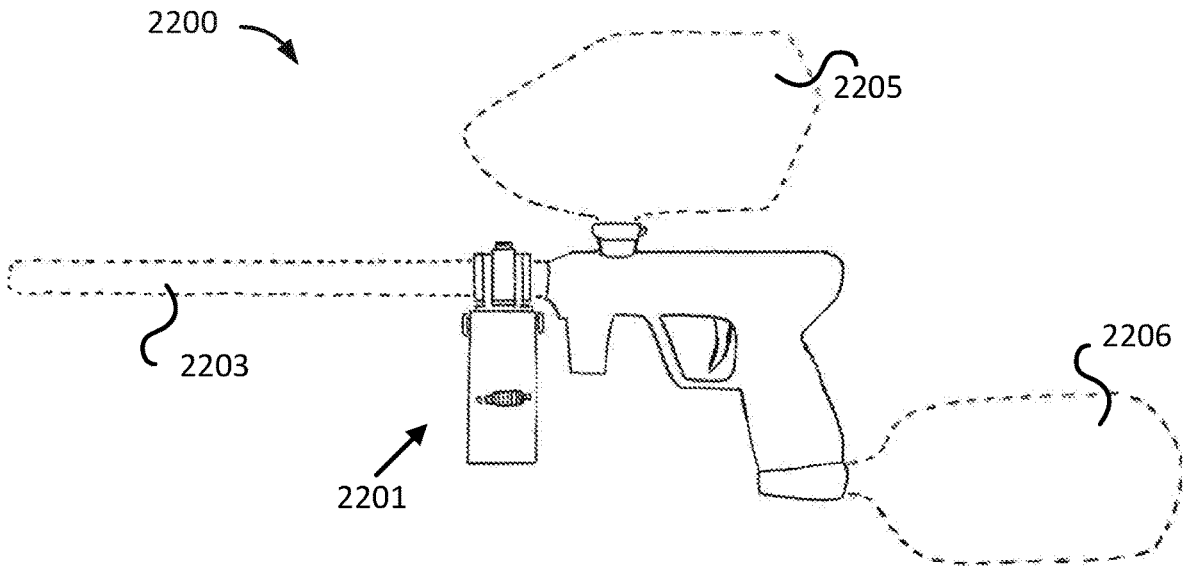
FIG. 24 is a perspective side view of the paintball marker of FIGS. 22 and 23 with the repositionable and rotatable forward grip component attached to a barrel connected to the paintball marker.
Figure 25:
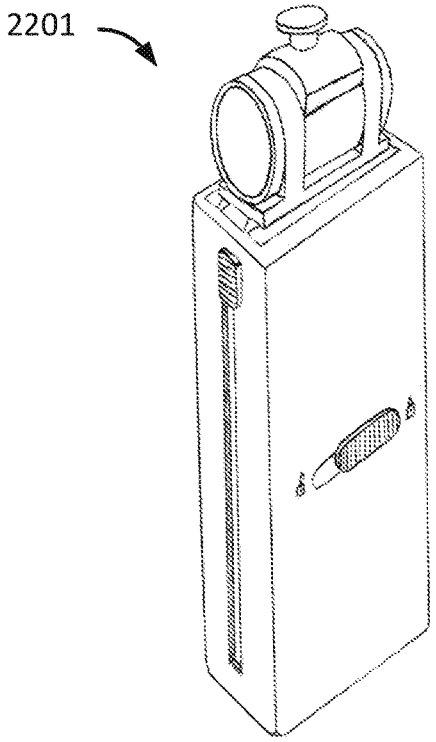
FIG. 25 is perspective angled side view of a repositionable and rotatable forward grip component in accordance with an embodiment.

FIG. 22 provides a side view of a paintball marker (2200) that includes a repositionable and rotatable forward grip component (2201) as disclosed herein. The paintball marker body (2202) and the repositionable and rotatable forward grip component are illustrated with solid lines, and the removable and attachable component of the paintball marker barrel (2203) is illustrated with dashed lines. The forward grip component is releasably attached to a post proximate to a muzzle end of the paintball marker (e.g., a muzzle end of the paintball marker body). The illustration of FIG. 23 depicts the paintball marker (2200) of FIG. 22 with the repositionable and rotatable forward grip component (2201) removed from a post (2204) of the paintball marker body (2202). FIG. 24 illustrates the paintball marker (2200) of FIGS. 22 and 23 with the repositionable and rotatable forward grip component (2201) attached to the paintball marker barrel (2203). Also illustrated with dashed lines in FIG. 24 are the removable and attachable components of the paintball marker hopper (2205) and gas supply (2206). FIG. 25 shows the repositionable and rotatable forward grip component (2201) of FIGS. 22-24 detached from the other elements of the paintball marker.

Figure 26:
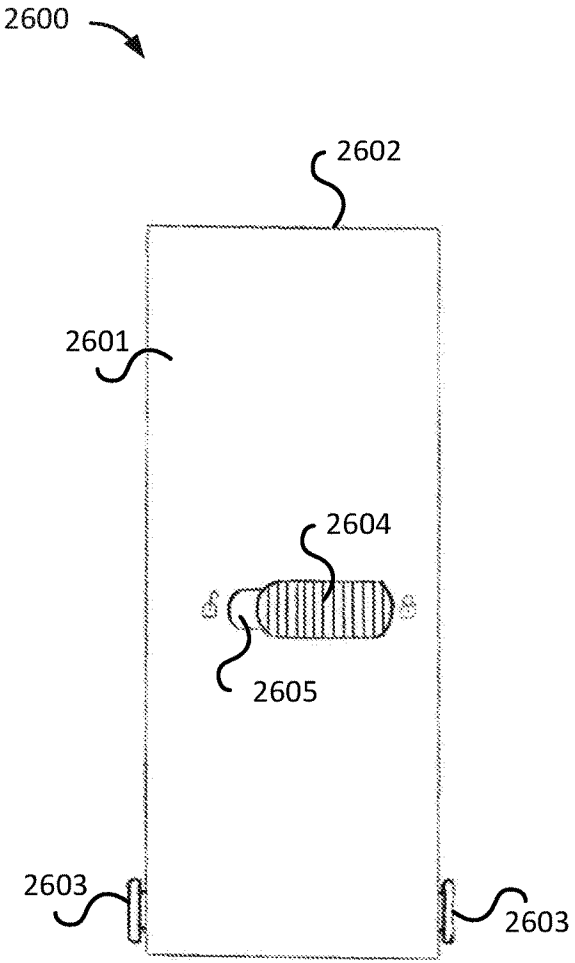
FIG. 26 is side view of a repositionable and rotatable forward grip component in accordance with an embodiment.

FIG. 26 illustrates a side view of a provided repositionable and rotatable forward grip component (2600). Shown in FIG. 26 is a grip member (2601) having a grip opening (2602) at one end (e.g., a grip member end). A pair of slide tabs (2603) protrude through a slide slits on opposite sides of the grip member. A lock tab (2604) is also shown protruding through a lock slit (2605) on another side of the grip member.

Figure 27:
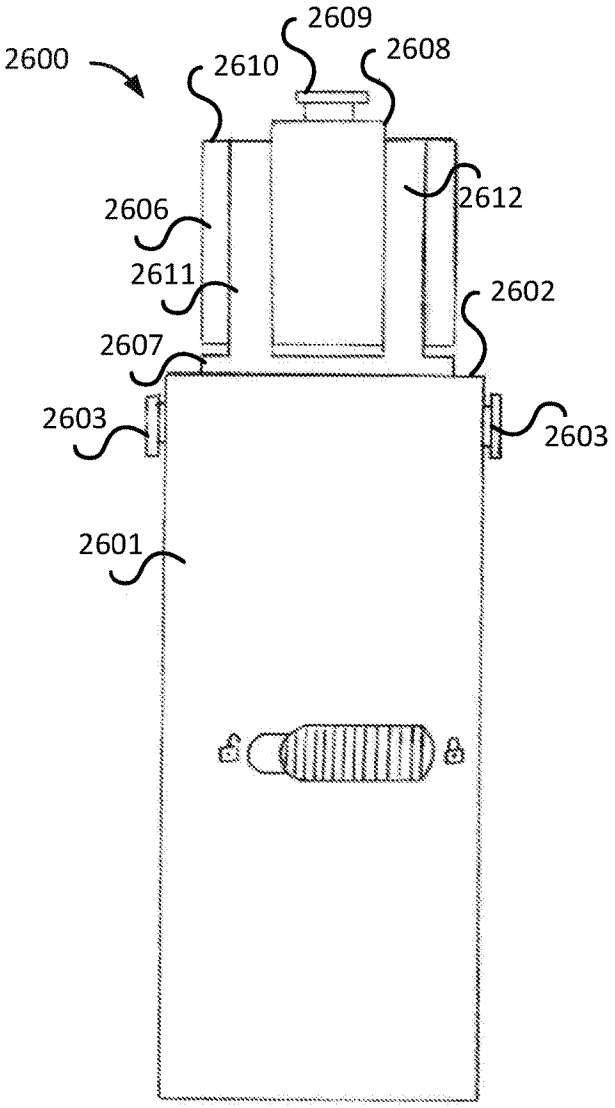
FIG. 27 is a side view of the repositionable and rotatable forward grip component of FIG. 26 with the swivel adapter extended from the grip member.

FIG. 27 illustrates the repositionable and rotatable forward grip component (2600) of FIG. 26 with a cylindrical shaft (2606) and a swivel adapter (2607) extended through the grip opening (2602) and out of a hollow grip interior of the grip member (2601). A collar (2608) encircles a portion of the cylindrical shaft, and a tightening screw (2609) passes through the collar towards a radial wall (2610) of the shaft.

The swivel adapter includes a first loop (2611) and a second loop (2612) that each encircles the cylindrical shaft on an opposite side of the collar from the other of two swivel adapter loops. The slide tabs (2603) are connected to the swivel adapter and move through the slide slits of the grip member as the swivel adapter is extended out of the grip member hollow interior.

The cylindrical shaft of the repositionable and rotatable forward grip component can have an axial length that is, for example, between 50 mm and 200 mm, e.g., between 50 mm and 140 mm, between 65 mm and 155 mm, between 80 mm and 170 mm, between 95 mm and 185 mm, or between 110 mm and 200 mm. In terms of upper limits, the shaft length can be less than 200 mm, e.g., less than 185 mm, less than 170 mm, less than 155 mm, less than 140 mm, less than 125 mm, less than 110 mm, less than 95 mm, less than 80 mm, less than 65 mm. In terms of lower limits, the shaft length can be greater than 50 mm, e.g., greater than 65 mm, greater than 80 mm, greater than 95 mm, greater than 110 mm, greater than 125 mm, greater than 140 mm, greater than 155 mm, greater than 170 mm, or greater than 185 mm. Larger lengths, e.g., greater than 200 mm, and smaller lengths, e.g., less than 50 mm, are also contemplated.

The hollow interior of the cylindrical shaft can have a diameter that is, for example, between 10 mm and 50 mm, e.g., between 10 mm and 34 mm, between 14 mm and 38 mm, between 18 mm and 42 mm, between 22 mm and 46 mm, or between 26 mm and 50 mm. In terms of upper limits, the shaft hollow interior diameter can be less than 50 mm, e.g., less than 46 mm, less than 42 mm, less than 38 mm, less than 34 mm, less than 30 mm, less than 26 mm, less than 22 mm, less than 18 mm, or less than 14 mm. In terms of lower limits, the shaft hollow interior diameter can be greater than 10 mm, e.g., greater than 14 mm, greater than 18 mm, greater than 22 mm, greater than 26 mm, greater than 30 mm, greater than 34 mm, greater than 38 mm. greater than 42 mm, or greater than 46 mm. Larger diameters, e.g., greater than 50 mm, and smaller diameters, e.g., less than 10 mm, are also contemplated.

The cylindrical shaft radial wall, the grip member, and the swivel adapter of the repositionable and rotatable forward grip component can each be constructed of identical or different materials. The radial wall, the grip member, and the swivel adapter can each independently include, for example, one or more metals, one or more rubbers, one or more polymers, or combinations thereof. In some embodiments, the grip member includes a least one rubber material positioned at one or more of its exterior surface regions. This configuration of grip member materials can improve the friction and feel of the grip member when held by a user of the paintball marker that includes the rotatable forward grip component.

In some embodiments, an exterior surface of the grip member includes one or more grooves. The grooves can have sizes and shapes configured to accommodate one or more fingers of a user when the grip member is held by a user of the paintball marker. In some embodiments, an exterior surface of the trigger lever includes one or more grooves configured to accommodate the fingers of the user. In certain aspects, the grip member and the trigger lever each include such grooves.

In certain aspects, the repositionable and rotatable forward grip component includes two slide tabs that each protrude through a different slide slit of the grip member. The slide tabs, as well as the lock tab of the forward grip component, can each include a textured surface to improve friction and grip with the fingers of a user of the paintball marker. The textured surfaces can include one or more grooves, one or more ridges, or a combination thereof. In some embodiments, the grip component includes only one slide tab protruding though one slide slit on one side of the grip member.

In some embodiments, the tightening screw of the repositionable and rotatable forward grip component passes through the forward grip collar towards the radial wall of the forward grip cylindrical shaft. In certain aspects, the tightening screw is configured to press against the radial wall, causing the wall to flex and contact a paintball marker component (e.g., the paintball marker barrel) within the hollow interior of the cylindrical shaft. In certain aspects, the tightening screw is configured to pass through a hole in the radial wall to contact a paintball marker component (e.g., the paintball marker barrel) within the shaft hollow interior. In certain aspects, the tightening screw is configured to pass through a hole in the radial wall to engage a hole (e.g., a threaded hole) in a paintball marker component (e.g., a paintball marker barrel) within the shaft hollow interior.

In some embodiment, the forward grip swivel adapter includes two loops that encircle the forward grip cylindrical shaft. The number of loops of the swivel adapter encircling the cylindrical shaft can be one, two, three, four, five, six, seven, eight, nine, ten, or more than ten.

Figure 29:
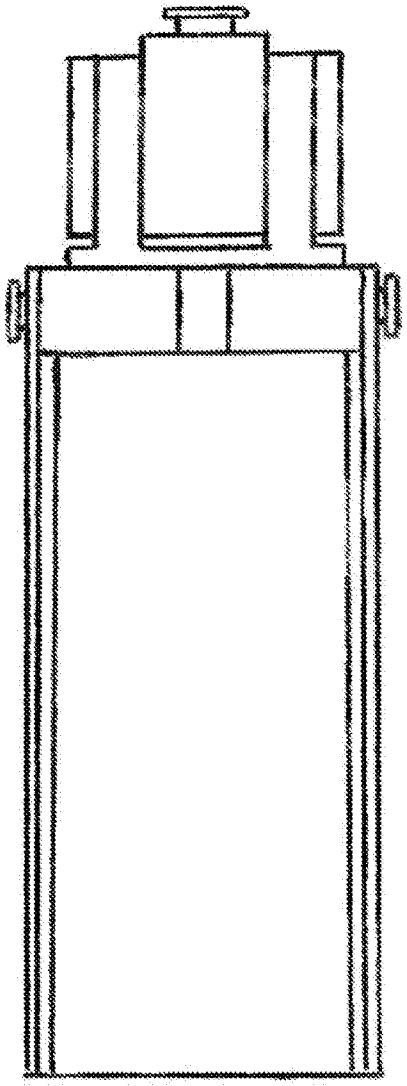
FIG. 29 is a side cross section view of the repositionable and rotatable forward grip component of FIG. 28 with the swivel adapter extended from the grip member.
Figure 28:
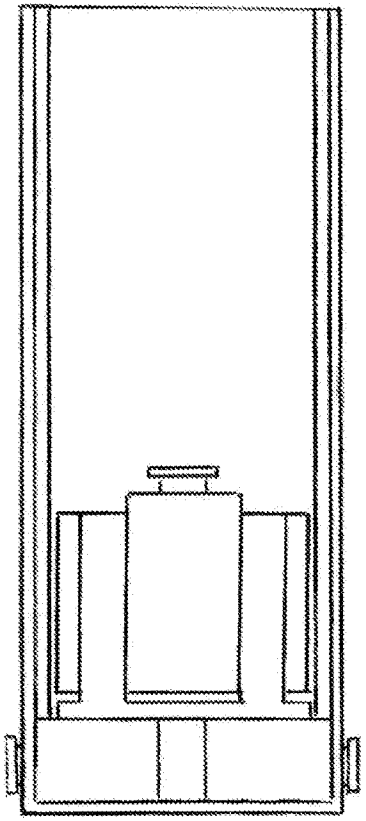
FIG. 28 is a side cross section view of a repositionable and rotatable forward grip component in accordance with an embodiment.

FIGS. 28 and 29 illustrate side cross section views of some of the elements of the repositionable and rotatable forward grip component of FIGS. 26 and 27. The forward grip component is depicted in FIG. 28 with the swivel adapter and cylindrical shaft retracted within the grip member, and the component is depicted in FIG. 29 with the swivel adapter and cylindrical shaft extended out from the grip member.

Figure 31:
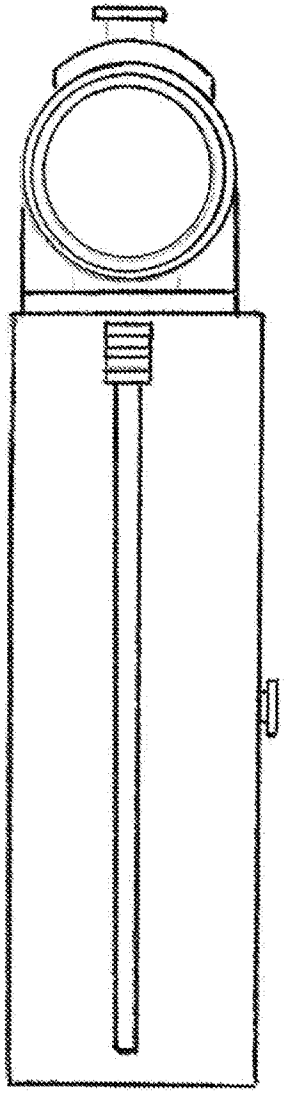
FIG. 31 is a frontal view of the repositionable and rotatable forward grip component of FIG. 30 with the swivel adapter extended from the grip member.
Figure 30:
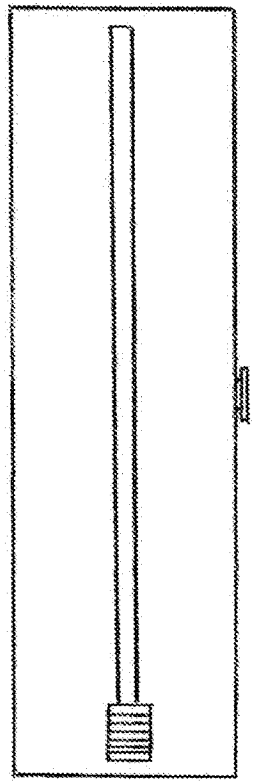
FIG. 30 is frontal view of a repositionable and rotatable forward grip component in accordance with an embodiment.

FIGS. 30 and 31 illustrate frontal views of some of the repositionable and rotatable forward grip component of FIGS. 26-29. The forward grip component is depicted in FIG. 30 with the swivel adapter and cylindrical shaft retracted within the grip member, and the component is depicted in FIG. 31 with the swivel adapter and cylindrical shaft extended out from the grip member.

Figure 33:
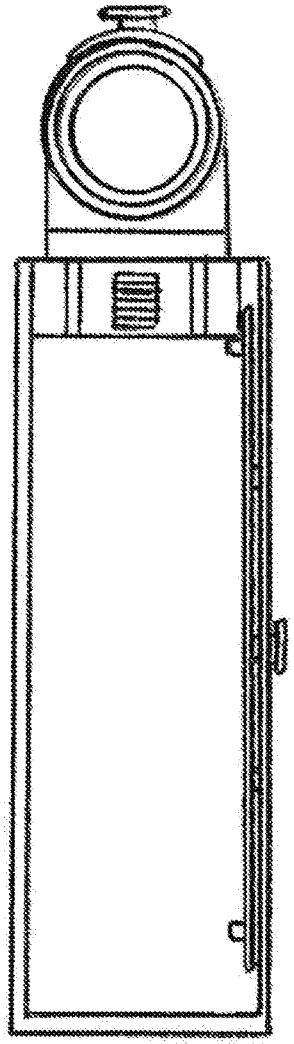
FIG. 33 is a frontal cross section view of the repositionable and rotatable forward grip component of FIG. 32 with the swivel adapter extended from the grip member.
Figure 32:
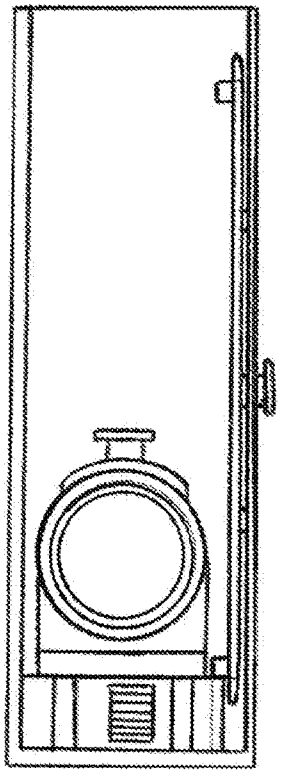
FIG. 32 is a frontal cross section view of a repositionable and rotatable forward grip component in accordance with an embodiment.

FIGS. 32 and 33 illustrate frontal cross section views of some of the elements of the repositionable and rotatable forward grip component of FIGS. 26-31. The forward grip component is depicted in FIG. 32 with the swivel adapter and cylindrical shaft retracted within the grip member, and the component is depicted in FIG. 33 with the swivel adapter and cylindrical shaft extended out from the grip member.

Figure 34:
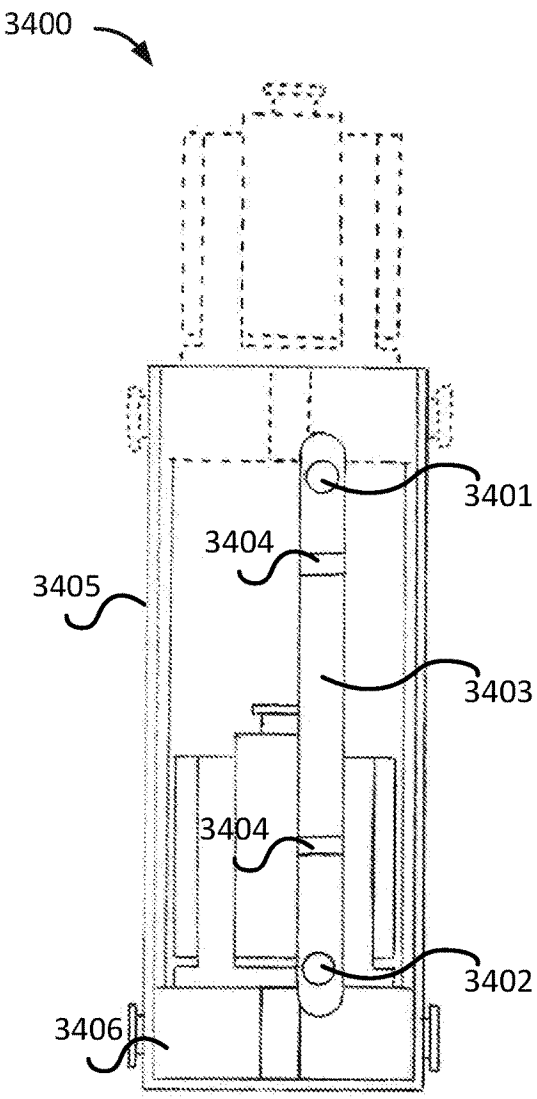
FIG. 34 is a side cross section view of a repositionable and rotatable forward grip component in accordance with an embodiment.

FIG. 34 illustrates a side cross section view of a provided repositionable and rotatable forward grip component (3400). Shown in the figure is an upper lock stopper (3401) and a lower lock stopper (3402) connected by a strip (3403). In some embodiments, and as shown in FIG. 34, the strip includes one or more ridges (3404) configured to mate with horizontal grooves, tracks, or slots in an interior wall surface of the grip member (3405). The stoppers and strip are configured such that the lower lock stopper prevents upward movement of the swivel adapter (3406) to extend the adapter outside of the grip member to the position indicated by the dashed lines in FIG. 34. In this locked position, the lower lock stopper can prevent upward movement of the swivel adapter from a lower position by contacting the swivel adapter. Also, in this locked position, when the swivel adapter is in an extended position outside of the grip member, the upper lock stopper can prevent downward movement of the swivel adapter to retract the adapter within the grip member. The upper lock stopper can prevent this downward movement by, for example, contacting the swivel adapter when the lock stoppers are in their locked position.

Figure 35:
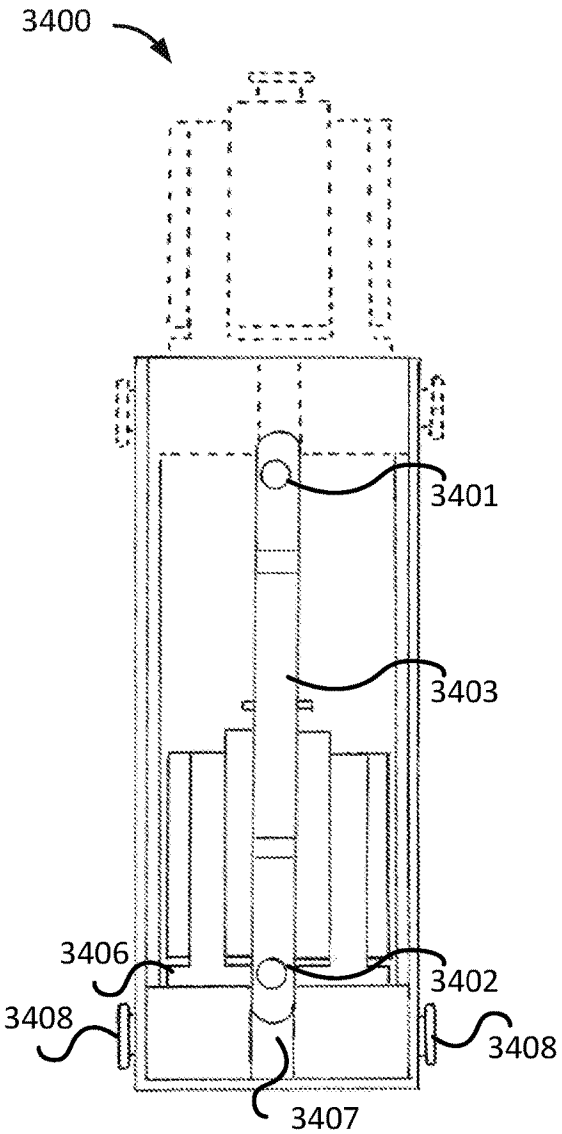
FIG. 35 is a side cross section view of the repositionable and rotatable forward grip component of FIG. 34 with dual stopper positioned in an unlocked position.

FIG. 35 illustrates a side cross section view of the repositionable and rotatable forward grip component (3400) of FIG. 34 with the upper lock stopper (3401), lower lock stopper (3402) and connecting strip (3403) translated horizontally to an unlocked position. The translation of the stoppers and strip can be achieved by, for example, moving a lock tab along a lock slit of the grip member, wherein the lock tab is connected to the strip and stoppers. In the unlocked position, the stoppers can permit movement of the swivel adapter (3406) in and out of the grip member (3405). This can be, for example, by an alignment of the lock stoppers with a groove (3407) in the swivel adapter, preventing or minimizing contact of the swivel adapter by the lock stoppers. The translation of the thus unlocked swivel adapter can be achieved by, for example, moving one or more slide tabs (3408) along one or more slide slits of the grip member.

Figure 37:
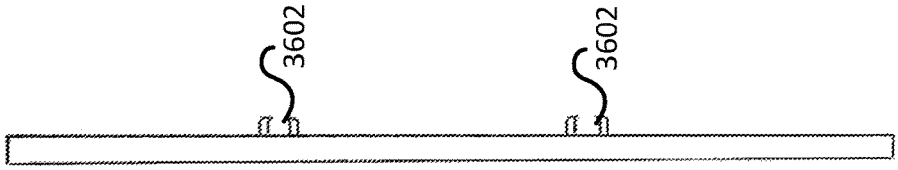
FIG. 37 is a side view of the interior wall of FIG. 36.
Figure 36:
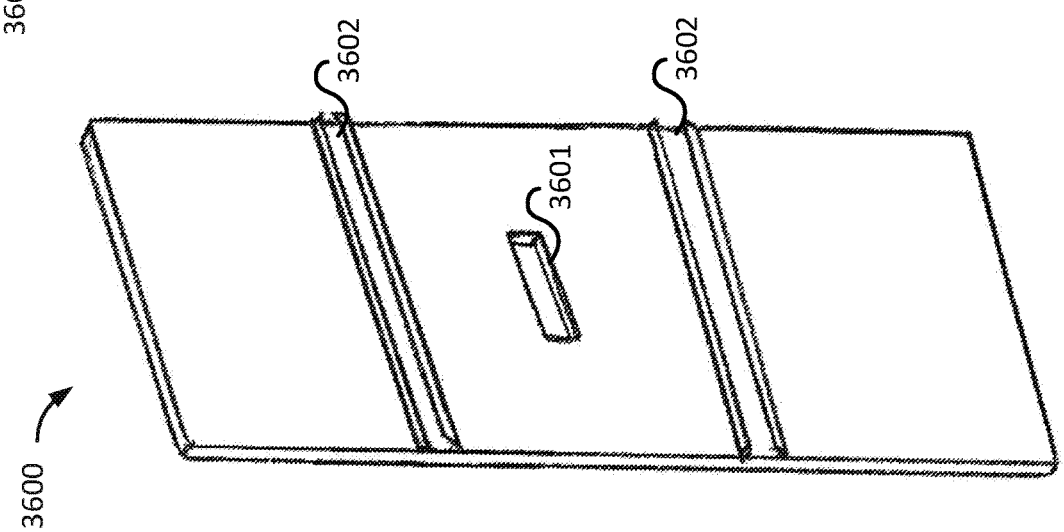
FIG. 36 is a perspective angled side view of slide grooves of an interior wall of a repositionable and rotatable forward grip component in accordance with an embodiment.

FIG. 36 illustrates the interior face of a grip member wall (3600) of a provided repositionable and rotatable forward grip component. Visible in the figure is the lock slit (3601) of the grip member, through which the lock tab of the forward grip component can protrude. Also shown are horizontal grooves (e.g., slide grooves) (3602) configured to mate with corresponding ridges of the strip connecting the lock stoppers of the forward grip component. The fitting of the lock stopper strip ridges with these grip member wall grooves can help to guide the translational movement of the lock stoppers as the connected slide tab is moved through the lock slit. FIG. 37 illustrates a side view of the grip member wall (3600), showing the horizontal slide grooves (3602) of the wall interior face.

Figure 39:
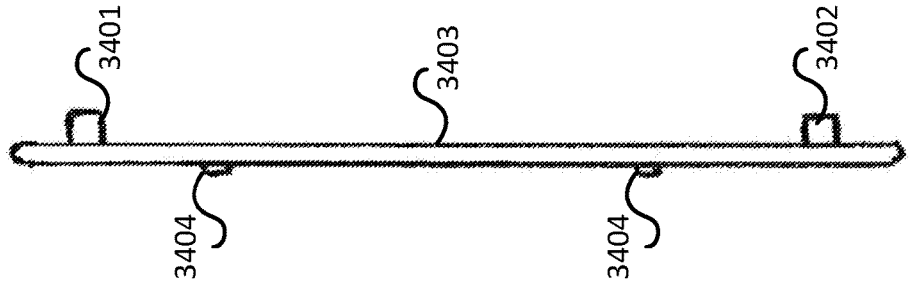
FIG. 39 is a side view of the lock stoppers and strip of FIG. 38.
Figure 38:
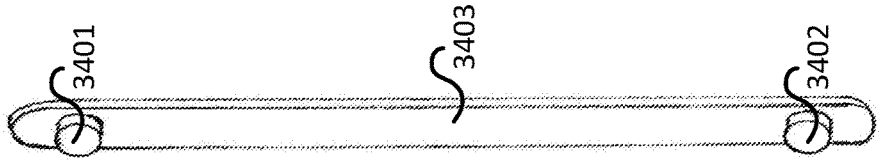
FIG. 38 is a perspective angled side view of a pair of lock stoppers positioned on a strip configured to mate with the slide grooves of FIGS. 36 and 37.

FIG. 38 illustrates a perspective view of the upper lock stopper (3401), the lower lock stopper (3402), and the connecting strip (3403) of the repositionable and rotatable forward grip component of FIGS. 34 and 35. FIG. 39 illustrates a side view of the upper lock stopper (3401), the lower lock stopper (3402), and the connecting strip (3403) and its ridges (3404) of the repositionable and rotatable forward grip component of FIGS. 34 and 35. The ridges of the strip of FIG. 39 can mate with the corresponding grooves of the grip member wall of FIGS. 36 and 37. In some embodiments, and as shown in FIGS. 34-39, the number of strip ridges and corresponding wall grooves is two. In some embodiments, the number of strip ridges and corresponding wall grooves is three, four, five, six, seven, eight, nine, ten, or more than ten.

Figure 40:
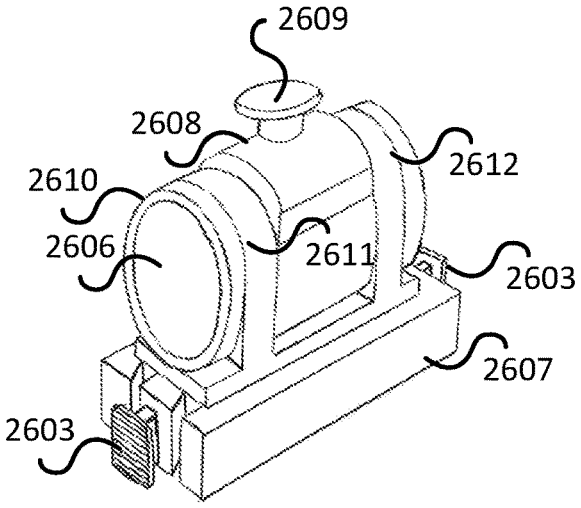
FIG. 40 is a perspective angle side view of the cylindrical shaft and swivel adapter of a repositionable and rotatable forward grip component in accordance with an embodiment.
Figure 41:
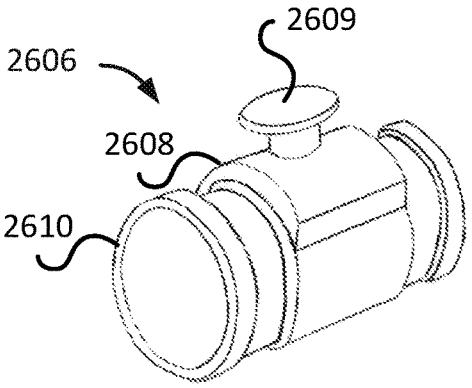
FIG. 41 is a perspective angle side view of the cylindrical shaft of a repositionable and rotatable forward grip component in accordance with an embodiment.
Figure 42:
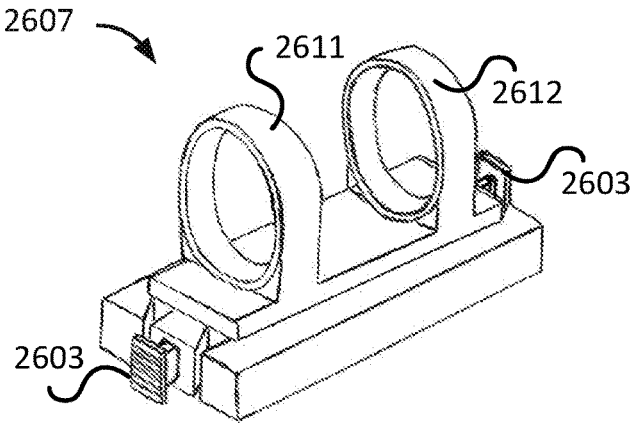
FIG. 42 is a perspective angle side view of the swivel adapter of a repositionable and rotatable forward grip component in accordance with an embodiment.

FIG. 40 illustrates the swivel adapter (2607) and cylindrical shaft (2606) of the repositionable and rotatable forward grip component of FIGS. 26-33. FIG. 41 illustrates cylindrical shaft (2606) of FIG. 40 separated from the swivel adapter. FIG. 42 illustrates the swivel adapter (2607) of FIG. 40 separated from the cylindrical shaft. Visible in the figures are the collar (2608), the tightening screw (2609), and the radial wall (2610) of the cylindrical shaft. Also shown are the slide tabs (2603), the first loop (2611), and the second loop (2612) of the swivel adapter.

Figure 45:
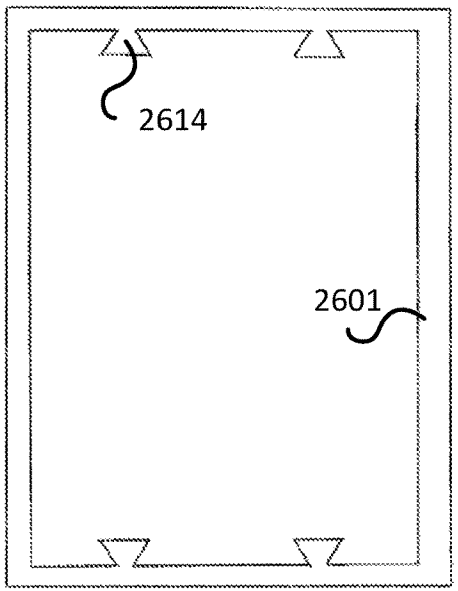
FIG. 45 is a top cross section view of the grip member of the repositionable and rotatable forward grip component of FIG. 43.
Figure 44:
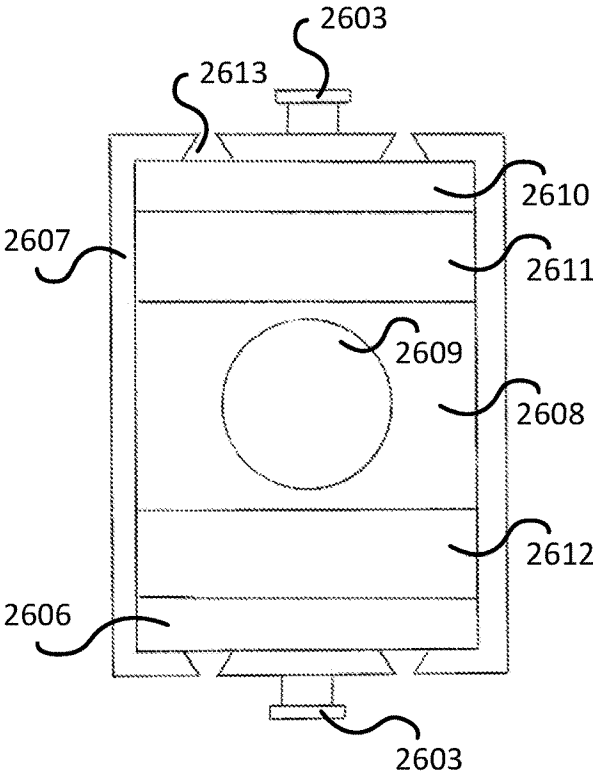
FIG. 44 is a top cross section view of the cylindrical shaft and swivel adapter of the repositionable and rotatable forward grip component of FIG. 43.
Figure 43:
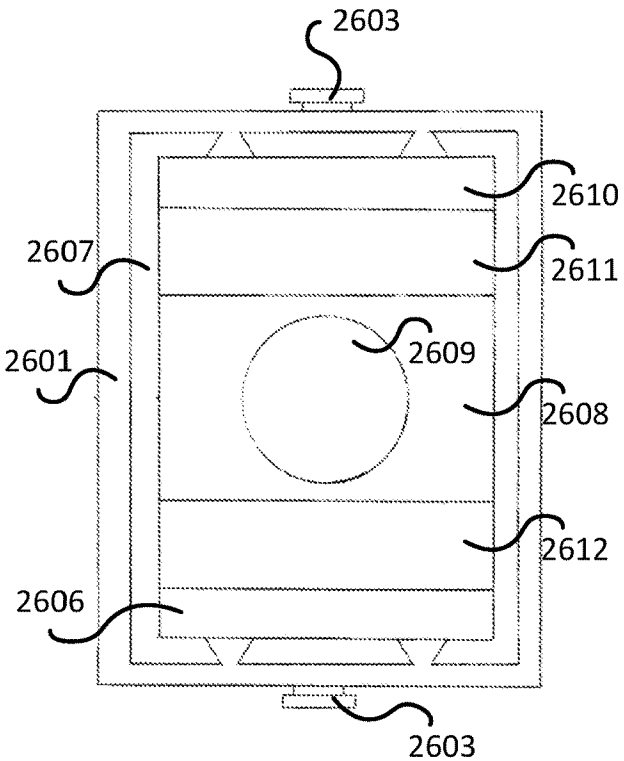
FIG. 43 is a top cross section view of a repositionable and rotatable forward grip component in accordance with an embodiment.

FIGS. 43 and 44 illustrate a top down view of the swivel adapter (2607) and cylindrical shaft (2606) of the repositionable and rotatable forward grip component of FIGS. 26-33 and 40-42. Visible in the figures are the collar (2608), the tightening screw (2609), and the radial wall (2610) of the cylindrical shaft. Also shown are the slide tabs (2603), the first loop (2611), and the second loop (2612) of the swivel adapter. The swivel adapter of FIG. 43 is shown connected to the grip member (2601) through multiple swivel adapters grooves (2613) and grip member ridges (2614). FIG. 45 illustrates a top down view of the grip member (2601) of FIG. 43 separated from the swivel adapter, and with the grip member ridges (2614) visible. In some embodiments, the connection of the swivel adapter and the grip member involves two or more swivel adapter ridges and grip member grooves. The number of ridges and complementary grooves on the surfaces of the swivel adapter and grip member can be, for example, two, three, four, five, six, seven, eight, nine, ten, or more than ten.

The terms "first" and "second", "upper", "lower", "inlet", and "outlet" as used herein with reference to elements or properties are simply to more clearly distinguish the elements or properties, and are not intended to indicate order, location, or direction. Although the foregoing disclosure has been described in some detail by way of illustration and example for purpose of clarity of understanding, one of skill in the art will appreciate that certain changes and modifications within the spirit and scope of the disclosure may be practiced, e.g., within the scope of the appended claims. It should also be understood that aspects of the disclosure and portions of various recited embodiments and features can be combined or interchanged either in whole or in part. In the foregoing descriptions of the various embodiments, those embodiments which refer to another embodiment may be appropriately combined with other embodiments as will be appreciated by one of skill in the art. Furthermore, those of ordinary skill in the art will appreciate that the foregoing description is by way of example only and is not intended to limit the disclosure. In addition, each reference provided herein is incorporated by reference in its entirety for all purposes to the same extent as if each reference was individually incorporated by reference.

What is claimed is:

1. A repositionable and rotatable forward grip component of a paintball marker, the forward grip component comprising:

a cylindrical shaft having a first longitudinal opening at a first longitudinal end, a second longitudinal opening at an opposite second longitudinal end, and a hollow shaft interior connecting the first and second longitudinal ends;

a swivel adapter encircling a portion of the shaft, wherein the swivel adapter can freely rotate about the shaft; and a grip member connected to the swivel adapter and comprising a grip opening at a grip member end, wherein the grip opening is configured to receive the swivel adapter and the cylindrical shaft upon retraction of the swivel adapter and the cylindrical shaft within a hollow grip interior of the grip member.

2. The forward grip component of claim 1, further comprising:

a collar encircling a portion of the shaft; and a tightening screw passing through the collar towards a radial wall of the shaft.

3. The forward grip component of claim 2, wherein the swivel adapter comprises a first loop and a second loop, and wherein the first and second loops encircle the shaft on opposite sides of the portion encircled by the collar.

4. The forward grip component of claim 1, wherein the swivel adapter further comprises a slide tab protruding through a slide slit of the grip member, wherein movement of the slide tab along the slide slit towards the grip member end causes extension of the swivel adapter out of the hollow grip interior, and wherein movement of the slide tab along the slide slit away from the grip member end causes the retraction of the swivel adapter within the hollow grip interior.

5. The forward grip component of claim 1, further comprising:

a pair of lock stoppers within the hollow grip interior; and a lock tab connected to the lock stoppers and protruding through a lock slit of the grip member, wherein movement of the lock tab along the lock slit causes at least one of the lock stoppers to initiate or release contact with the swivel adapter.

6. A paintball marker comprising a repositionable and rotatable forward grip component, wherein the forward grip component is releasably connected to a post proximate to a muzzle end of the paintball marker, and wherein the forward grip component comprises:

a cylindrical shaft having a first longitudinal opening at a first longitudinal end, a second longitudinal opening at an opposite second longitudinal end, and a hollow shaft interior connecting the first and second longitudinal ends;

a swivel adapter encircling a portion of the shaft, wherein the swivel adapter can freely rotate about the shaft; and a grip member connected to the swivel adapter and comprising a grip opening at a grip member end, wherein the grip opening is configured to receive the swivel adapter and the cylindrical shaft upon retraction of the swivel adapter and the cylindrical shaft within a hollow grip interior of the grip member.

7. The paintball marker of claim 6, wherein the forward grip component further comprises:

a collar encircling a portion of the shaft; and a tightening screw passing through the collar towards a radial wall of the shaft.

8. The paintball marker of claim 7, wherein the swivel adapter comprises a first loop and a second loop, and wherein the first and second loops encircle the shaft on opposite sides of the portion encircled by the collar.

9. The paintball marker of claim 6, wherein the swivel adapter further comprises a slide tab protruding through a slide slit of the grip member, wherein movement of the slide tab along the slide slit towards the grip member end causes extension of the swivel adapter out of the hollow grip interior, and wherein movement of the slide tab along the slide slit away from the grip member end causes the retraction of the swivel adapter within the hollow grip interior.

10. The paintball marker of claim 6, wherein the forward grip component further comprises:

a pair of lock stoppers within the hollow grip interior; and a lock tab connected to the lock stoppers and protruding through a lock slit of the grip member, wherein movement of the lock tab along the lock slit causes at least one of the lock stoppers to initiate or release contact with the swivel adapter.

11. A method of repositioning a rotatable forward grip component of a paintball marker, the method comprising:

providing a paintball marker kit comprising the paintball marker, a barrel connected to the paintball marker, and the forward grip component, wherein the forward grip component is releasably connected to a post proximate to a muzzle end of the paintball marker, and wherein the forward grip component comprises:

a cylindrical shaft having a first longitudinal opening at a first longitudinal end, a second longitudinal opening at an opposite second longitudinal end, and a hollow shaft interior connecting the first and second longitudinal ends;

a swivel adapter encircling a portion of the shaft, wherein the swivel adapter can freely rotate about the shaft; and a grip member connected to the swivel adapter, wherein the swivel adapter is within a hollow grip interior of the grip member;

detaching the forward grip component from the post;

extending the swivel adapter from a grip opening at a grip member end of the grip member;

and inserting the barrel through the hollow shaft interior.

12. The method of claim 11, wherein the forward grip component further comprises a collar encircling a portion of the shaft, wherein the forward grip component further comprises a tightening screw passing through the collar towards a radial wall of the shaft, and wherein the method further comprises tightening the tightening screw, thereby pressing the shaft against the barrel.

13. The method of claim 12, wherein the swivel adapter comprises a first loop and a second loop, and wherein the first and second loops encircle the shaft on opposite sides of the portion encircled by the collar.

14. The method of claim 11, wherein the swivel adapter further comprises a slide tab protruding through a slide slit of the grip member, and wherein the extending of the swivel adapter comprises moving the slide tab along the slide slit towards the grip member end.

15. The method of claim 11, wherein the forward grip component further comprises:

a pair of lock stoppers within the hollow grip interior; and a lock tab connected to the lock stoppers and protruding through a lock slit of the grip member, wherein the extending of the swivel adapter comprises moving the lock tab along the lock slit, thereby initiating contact between at least one of the lock stoppers and the swivel adapter.

* * * * *